US005365868A

United States Patent [19]

Culotta

[11] Patent Number: 5,365,868

[45] Date of Patent: Nov. 22, 1994

[54] UNDERWATER PROPULSION SYSTEM HAVING REDUCED WEIGHT PENALTY AND VARIABLE ANGLE OF THRUST

[76] Inventor: Kenneth W. Culotta, 1141 Willa Vista Trail, Maitland, Fla. 32751

[21] Appl. No.: 74,368

[22] Filed: Jun. 10, 1993

[51] Int. Cl.[5] ..... B63G 8/00

[52] U.S. Cl. ..... 114/315; 114/338; 440/6; 405/185

[58] Field of Search ..... 114/315, 338; 440/6, 440/84, 87; 405/185, 186, 187

[56] References Cited

U.S. PATENT DOCUMENTS

| | | | |
|---|---|---|---|
| 3,014,448 | 12/1961 | Fogarty et al. . | |
| 3,034,467 | 5/1962 | Pestronk . | |
| 3,063,394 | 11/1962 | Rebikoff | 114/315 |
| 3,128,739 | 4/1964 | Schultz . | |
| 3,329,118 | 7/1967 | Strader . | |
| 3,916,814 | 11/1975 | Bardoni et al. . | |
| 3,995,578 | 12/1976 | McCullough . | |
| 4,220,110 | 9/1980 | Roberson et al. . | |
| 4,753,187 | 6/1988 | Galimand . | |
| 4,813,367 | 3/1989 | Stevenson | 114/315 |
| 4,843,998 | 7/1989 | Parker | 114/315 |
| 4,996,938 | 3/1991 | Cameron et al. . | |
| 5,170,739 | 12/1992 | Kobayashi | 114/315 |

FOREIGN PATENT DOCUMENTS

| | | |
|---|---|---|
| 1223276 | 6/1960 | France . |
| 2445324 | 1/1976 | Germany . |
| 63-17196 | 1/1988 | Japan . |

*Primary Examiner*—Stephen P. Avila
*Attorney, Agent, or Firm*—Julian C. Renfro

[57] ABSTRACT

A propeller driven underwater propulsion system for use by a scuba diver, comprising at least one elongate air tank to be carried on the back of the diver, with the longitudinal centerline of the tank residing in a plane approximately perpendicular to the plane of the shoulders of the diver. A propeller is operatively mounted for rotation at a location closely adjacent the rear end of the tank, but it is neither rigidly connected to nor directly supported by the tank. A motor mounting arrangement operatively supports a motor adjacent the tank, with a motor output shaft being operatively connected by a torque transmitting device for continuously supplying rotative power to the propeller, such that the propeller provides a line of thrust at a location directed essentially rearwardly of the tank. Significantly, the angularity of the propeller shaft with respect to the longitudinal centerline of the tank can be readily modified at the behest of the diver so as to enable the line of thrust of the propeller to be tilted away from the longitudinal centerline of the tank and the body of the diver. The selective adjustment of the line of thrust of the propeller effectively compensates for the fact that line of thrust of the propeller is inherently laterally offset from the body of the diver. It is apparent that the selective tilt of the line of thrust of the propeller enables the diver to readily travel in a desired direction underwater.

46 Claims, 8 Drawing Sheets

UNDERWATER PROPULSION SYSTEM HAVING REDUCED WEIGHT PENALTY AND VARIABLE ANGLE OF THRUST

BACKGROUND OF THE INVENTION

Over the years, numerous devices for electric underwater propulsion for scuba divers have been developed. Some of these involve the scuba diver holding the device in his hands, whereas other solutions involve the attaching of the propulsion system to the scuba diver's equipment.

A problem with hand held devices is that they fatigue the scuba diver's arms inasmuch as he has to "hang on" as he is pulled through the water. Another problem with prior art components is that they restrict the scuba diver's ability to function "hands free" since he must carry the device.

Yet another problem is that it restricts a scuba diver's mobility since he must be able to let go of the device in order to use his hands. In this instance, the diver must be able to, in some fashion, secure the device by resting it in some suitable place, or tethering it to something.

Problems also exist with propulsion devices that attach to a scuba diver's equipment, for in order for these mounted devices to function properly, the scuba diver must face a number of sacrifices and restrictions. For example, it is known that a properly weighted scuba diver is almost neutrally buoyant when he is at the surface of the water. Any additional equipment that he carries such as a propulsion device, must also be approximately neutrally buoyant, so as not to upset this balance. For the propulsion device to be near neutrally buoyant it must displace, when submerged, an amount of water almost equal to its weight. Hence, the volume and weight are directly proportional.

An initial problem encountered when attaching a propulsion device to a scuba diver's equipment is how to offset the weight of the device while keeping the bulk to a minimum. One solution would be to reduce the size of the scuba diver's air tank, to make room for the additional volume needed to offset the weight of the propulsion device. This approach was recognized by the Strader U.S. Pat. No. 3,329,118 and the Galimand U.S. Pat. No. 4,753,187. However, this reduction in the volume of compressed air carried severely limits the amount of time the scuba diver can stay submerged. This problem is solved by using a more efficient battery such as the kind used in McCullough U.S. Pat. No. 3,995,578 as well as Strader '118. This approach becomes impractical, however, in terms of economics and battery cycle life. Another option is just to use a smaller, less expensive battery, possibly in conjunction with a smaller motor, as did Bardoni et al in their U.S. Pat. No. 3,916,814. In this latter instance, the diver would have to settle for less performance.

Another solution would be to reduce the size and weight of the battery. The problem here is that a practical, rechargeable battery such as a sealed lead-acid battery has low energy density, meaning that a smaller and lighter battery has less power. This of course results in reduced operating time for the device. Therefore, to obtain a reasonable operating time for the device, the excessive weight and size of the more practical battery must be incurred.

A novel solution to this problem was the recognition of the fact that scuba divers wear leaded weight belts in order to achieve a near neutral buoyancy at the surface of the water. It can be reasoned therefore, that the battery pack for the propulsion device could be used in lieu of the lead weights to accomplish the desired balance. This approach was recognized by Parker U.S. Pat. No. 4,843,998. A problem exists, however, with regard to the approach set forth in the Parker patent, which is that not all divers require the same amount of weight to obtain the desired buoyancy. A smaller scuba diver needs less weight to submerge than a larger one, and the size of the wetsuit a diver may or may not use also effects this condition.

Therefore, some divers may be forced to wear a smaller battery pack so as not to upset his or her weight balance in the water. Again, this reduces the operating time of the propulsion device.

Another problem is the proper location of the propulsion device that is attached to scuba diver's equipment. Having the propulsion device mounted longitudinally parallel to the diver's air tank, but laterally displaced therefrom gives way to at least two undesirable effects.

One undesirable effect is that the center of thrust is further removed from the diver's center of gravity. This means that the thrust line must be redirected so as to reside at a greater angle towards the diver in order for him to achieve a more horizontal motion when traveling forward through the water. Still another problem is the larger silhouette created by this location.

Ideally, the propulsion device should be placed in a position such that the thrust line is laterally displaced from the diver's center of gravity to the smallest extent possible. Various attempts to take this into consideration can be noted from the configurations of the devices taught by Fogarty U.S. Pat. No. 3,014,448, Pestronk U.S. Pat. No. 3,034,467, Schultz U.S. Pat. No. 3,128,739 and Strader '118.

The Cameron et al U.S. Pat. No. 4,996,938 captioned "Apparatus for Propelling a User in an Underwater Environment," bears some relationship to the instant invention, but it is to be immediately noted that the user of the Cameron et al device must at all times be using both hands for holding and controlling the apparatus. This is of course a distinct disadvantage to any diver needing both hands free for completing other tasks.

Another important point is that Cameron et al apparently has wasted space in their hull assembly 12, for the diver still has to carry conventional air tanks on his back. This of course is a disadvantage when compared with the use of an air tank serving the multiple purposes of supplying breathable air for the diver as well as in serving as a structural mounting for the propulsion components.

Still another important point is that in Cameron et al patent, there is no provision for locking the motor and propellers in a fixed relationship to the diver.

Whereas all of the devices mentioned hereinabove present a distinct impracticality in some aspect of their design, involving one or more problems with economics, configuration, weight, and/or performance, my highly advantageous configuration for a diver's underwater propulsion system overcomes these problems in a highly satisfactory manner.

SUMMARY OF THE INVENTION

A propeller driven underwater propulsion system for use by a scuba diver is taught herein, which underwater propulsion system is to be utilized in conjunction with an air tank to be mounted on the diver's back. An electric motor is utilized for driving the propeller in rotation, with this motor being supplied with electric power from an elongate battery tube secured on each side of the air tank. At least one mounting strap of relatively rigid material encircles the tank and a mid portion of the battery tubes, with means thereon for supporting the electric motor operatively connected to drive the propeller in rotation. Forward and rear motor mounting means are provided for supporting the motor, with the forward support means disposed on the mounting strap at the location of one of the elongate battery tubes. A rear strap of relatively rigid material encircles a rear portion of the one battery tube. An elongate support arm of rigid construction having a forward end and a rear end is utilized, with the angular position of this support arm with respect to the longitudinal centerline of the air tank advantageously being adjustable.

The forward and rear motor mounting means are affixed to the support arm at spaced locations thereon, with the forward end of the support arm being supported from the forward support means disposed upon the mounting strap. The rear end of the support arm is supported from the rear strap encircling the rear portion of the one battery tube.

The forward end of the elongate arm is mounted for rotation to a limited extent about a pivot point contained in the forward support means, and the rear end of the elongate arm is slidably mounted in an adjustment member mounted on the rear strap. The adjustment member contains an arcuate slot, and tightening means are operatively associated with the elongate arm and the adjustment member for enabling the user to establish a desired angle of inclination of the elongate arm with respect to the longitudinal centerline of the air tank. Importantly, the angular adjustments of the elongate arm enables the centerline of the motor and the propeller operatively associated therewith to be moved to a selected angle with respect to the centerline of the air tank.

A primary object of this invention is therefore to provide a compact, hands-free underwater propulsion arrangement for a scuba diver, that has an adjustable thrust angle that can improve the diver's plane through the water.

Another object of this invention is to provide an improved propulsion arrangement for a scuba diver, involving the use of an air tank of lightweight construction for eliminating excess weight, with the aft end of such tank being rounded so as to interact in a highly advantageous manner with a pivotally mounted propeller drive arrangement, with turbulence in the water flowing around the aft end of the tank being minimized by the use of a precisely movable fairing arrangement.

Still another object of this invention is to provide a tiltable propeller arrangement driven by a torque transmitting device, preferably an endless drive member, which propeller arrangement can be tilted in unison with the electric motor used for driving the propeller in rotation, thus to improve the angle of plane of the diver as he or she travels through the water.

Yet another object of this invention is to provide a highly effective support arrangement for the components of an electric propulsion system intended for underwater use, with an air tank of lightweight construction forming the basic unit upon which the components are mounted in a highly advantageous manner.

Yet still another object of this invention is to provide a greatly improved, hands-free propulsion arrangement for a scuba diver, wherein the advantageous placement of the propeller behind the air tank makes operation on the surface of the water readily possible, when such is warranted.

Yet still another object of this invention is to provide a propulsion arrangement for a scuba diver in which the motor is effectively isolated from the battery, thus lessening the possibility of an explosion in the unlikely event that arcing takes place at the motor.

Yet still another object of this invention is to provide a hands-free propulsion arrangement usable by a scuba diver, that can be produced at a reasonable cost, and with the performance of the propulsion motor being able to be closely controlled at all times by the use of a system controller worn on a convenient location on the diver's forearm.

These and other objects, features and advantages of this invention will become more apparent as the description proceeds.

DETAILED DESCRIPTION

Figure 1:
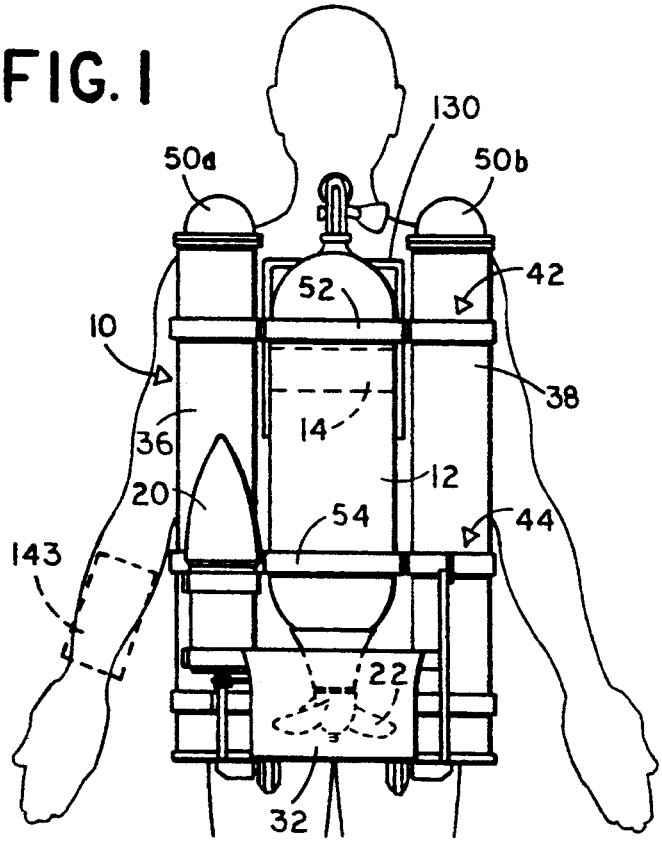
FIG. 1 is a view from the rear of my novel propulsion system installed on the back of a diver, this view revealing the centrally disposed air tank, the elongate battery tube mounted on each side of the air tank, and the electric motor utilized for driving the propeller being mounted in an offset relation.
Figure 2:
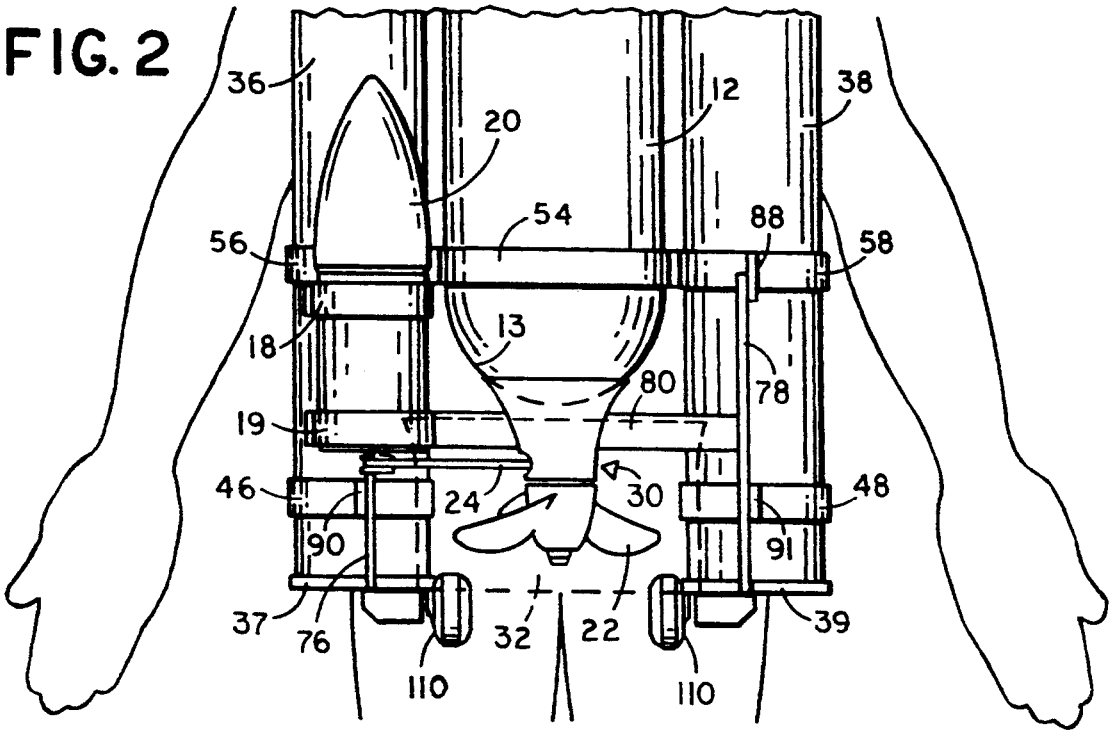
FIG. 2 is a view representing an enlargement of certain detail shown in FIG. 1, and more particularly revealing the arrangement of the propulsion components.

With initial reference to FIG. 1, and to FIG. 2, which represents an enlargement of significant propulsion details of FIG. 1, it will be seen that I have shown my novel propulsion system 10 that is worn on the back of a diver, and utilized in conjunction with an air tank 12 that furnishes a supply of air to the diver while submerged. The customary breathing apparatus supplied with air from the tank 12 for usage by the diver, such as the regulator, forms no part of this invention.

An electric motor 20 furnishes the propulsive effort for my novel underwater propulsion system 10, with the batteries powering the motor 20 being contained in the battery tubes 36 and 38 located on each side of the air tank 12. The motor 20 may for example be a trolling motor, but obviously I am not limited to this.

Figure 4:
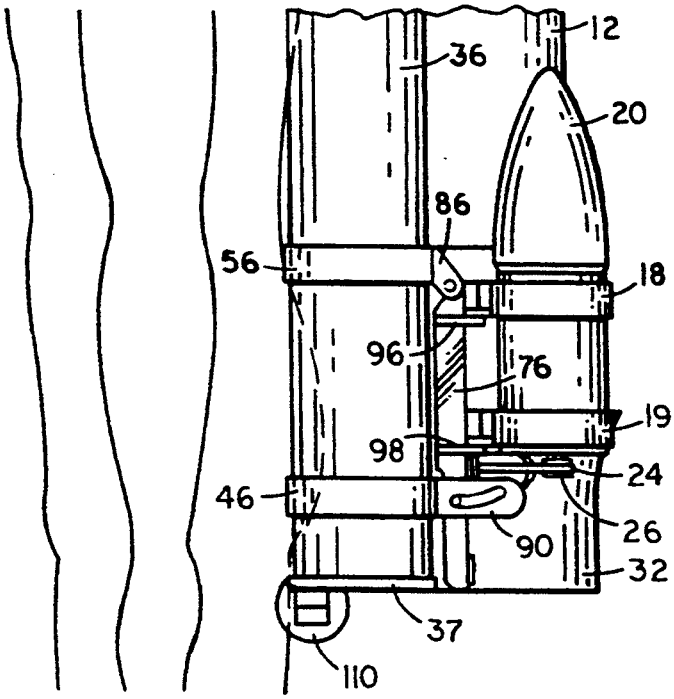
FIG. 4 is a view representing an enlargement of certain detail shown in FIG. 3, and again revealing additional propulsion details.
Figure 11:
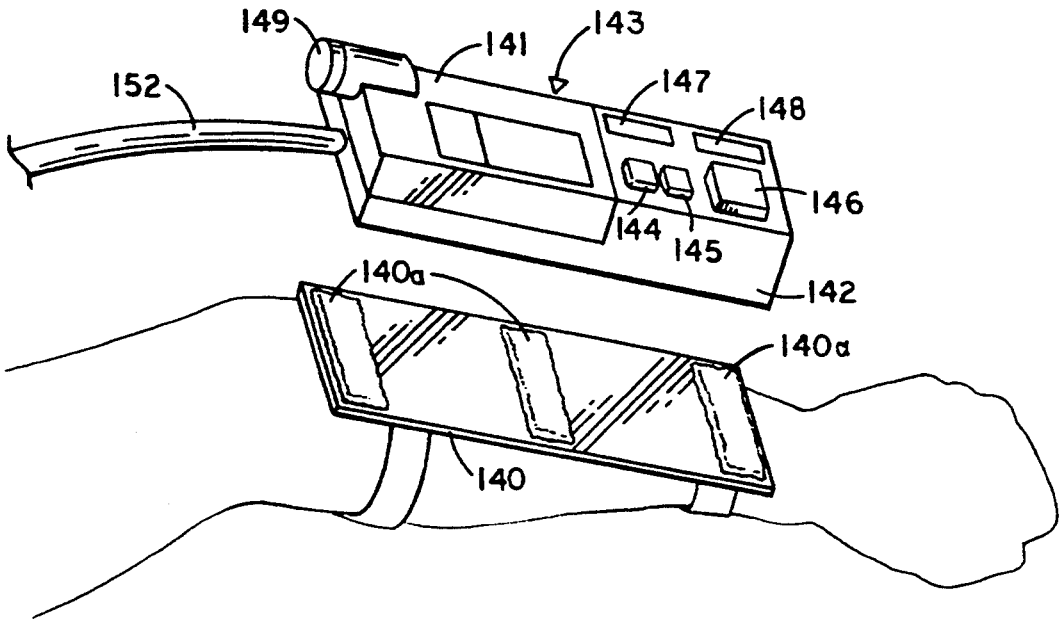
FIG. 11 is a view of the controller intended to be mounted on the diver's forearm for convenient access in controlling speed of the motor, as well as providing the diver information as to the motor speed and battery condition.

A system controller 143 is worn on a mounting pad secured to the forearm of the diver, in the manner generally illustrated in FIGS. 1, 2 and 4, and specifically illustrated in FIG. 11. Because of the convenient location of the controller 143, the diver is readily able to control the propulsive effort put forth by the motor 20.

Figure 3:
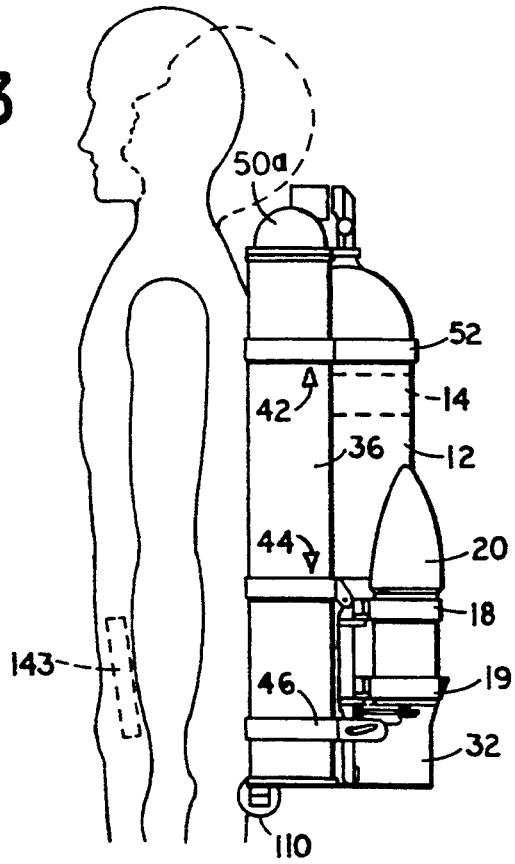
FIG. 3 is a side view of the diver of FIG. 1, this view revealing that the air tank protrudes further rearwardly than the battery tubes, and also showing the low silhouette of the arrangement I prefer to use.

FIG. 3 represents a side view of the principal components of my device, with it to be seen from this figure that the motor 20 is located slightly further out from the diver's body than is the air tank 12.

Although I am not to be limited to any particular components or hardware for securing the propulsion system 10 to the diver's back, it is customary for a scuba diver to wear a buoyancy compensator (BC), so that he or she can compensate for the load being borne in a particular instance. The BC may be regarded as an inflatable bladder generally in the configuration of a vest, that is powered off of the air tank used to supply air to be breathed by the diver. One part of the BC involves a valve (not shown), under the control of the diver, and the appropriate manipulation of this valve enables the diver to obtain neutral buoyancy at various depths. It is to be understood that the BC is not per sea part of this invention.

The buoyancy compensator has a wide rear strap, or pair of straps. Such rear strap or straps of the BC can be readily passed around a mid portion of the air tank 12, and then tightened to a desired extent. Such a strap location is shown in dashed lines at 14 in FIGS. 1 and 3, so in a manner of speaking it may be regarded that the air tank 12 forms a support for the propulsion components now to be described. Unlike many scuba tanks in use today, the tank 12 in accordance with this invention has a curved, rounded bottom portion 13, which rounded configuration is utilized for a reason pointed out at length hereinafter.

It is to be understood that the air tank 12 I prefer to use is made of lightweight material such as fiber-reinforced aluminum, which weighs some 20 pounds less than a tank made of metal. Significantly, this lightweight tank weighs less than the water it displaces, thus providing a lifting effect that helps offset the weight of the additional equipment utilized for propulsion. This arrangement is one of the advantageous aspects of my invention.

It is to be understood that the air tank 12 provides several important functions in addition to supplying the air to be breathed by the diver, these being to serve as a mounting structure for the entire system; to offset part of the weight of the equipment by being positively buoyant; and to serve as a flow directing means in helping direct the flow of water through the propeller.

Although the air tank and the other components of my tiltable propulsion arrangement for a diver are comparatively light, I provide a pair of wheels 110 on the underside of the arrangement, adapting it for occasional overland travel, these wheels best being seen in FIGS. 2, 4, 6 and 10.

FIGS. 1 and 2 reveal that the adjustably mounted electric motor 20 provides motive power to propeller 22 via a suitable torque transmitting device. I prefer to use as the torque transmitting device, an endless drive member 24, which is generally indicated in FIG. 2, and shown in greater detail in FIG. 5. Other torque transmitting devices could be utilized within the spirit of this invention, but I prefer to use an endless drive member in view of its simplicity.

It is to be noted that the endless drive member 24 may be a drive chain of non-metallic material, such as nylatron. However, I am not to be limited to this particular endless drive member, for the member 24 could also be a toothed belt. It is to be noted that inasmuch as the use of a toothed belt would be under water, it is desirable that the pulleys utilized in conjunction with a toothed belt contain sufficient relief on the side or sides of each pulley, as will permit the escape of the water tending to be trapped between the teeth of the belt and the pulley.

As will be seen from both FIG. 1 and FIG. 2, the motor 20 in this instance is disposed on the left hand side of the propulsion system, when viewed from the rear. The mounting arrangement for the motor will be described in greater detail hereinafter, but as will be noted in FIGS. 1 through 4, I use a pair of motor-encircling straps, forward strap 18 and aft strap 19, in conjunction with its support. However, I am not to be limited to this particular position for the motor 20.

The output of the motor 20 is furnished by means of pulley 26 to endless drive member 24, and from drive member 24 to the shaft 23. The shaft 23 is slightly visible in FIG. 5, but is more clearly visible in FIG. 8. It is upon shaft 23 that the propeller 22 is mounted, being held in place by a pin 116; note FIG. 8. It is to be observed, such as in FIGS. 1 and 2, that the propeller 22 is basically located on the longitudinal centerline of the air tank 12 at a location directly behind the air tank, but it is most important to note that the propeller 22 and its support mechanism are not directly carried by the air tank. Rather, the propeller and its support mechanism are arranged such that they may be tilted outwardly in a carefully selected manner, away from direct alignment with the air tank and away from the diver for an appropriate extent. Because of the novel mounting arrangement I utilize, my underwater propulsion system is effectively able to be tilted away from the body of the diver, thus to compensate for the fact that the propulsive effect created by the propeller is offset from the diver.

Figure 6:
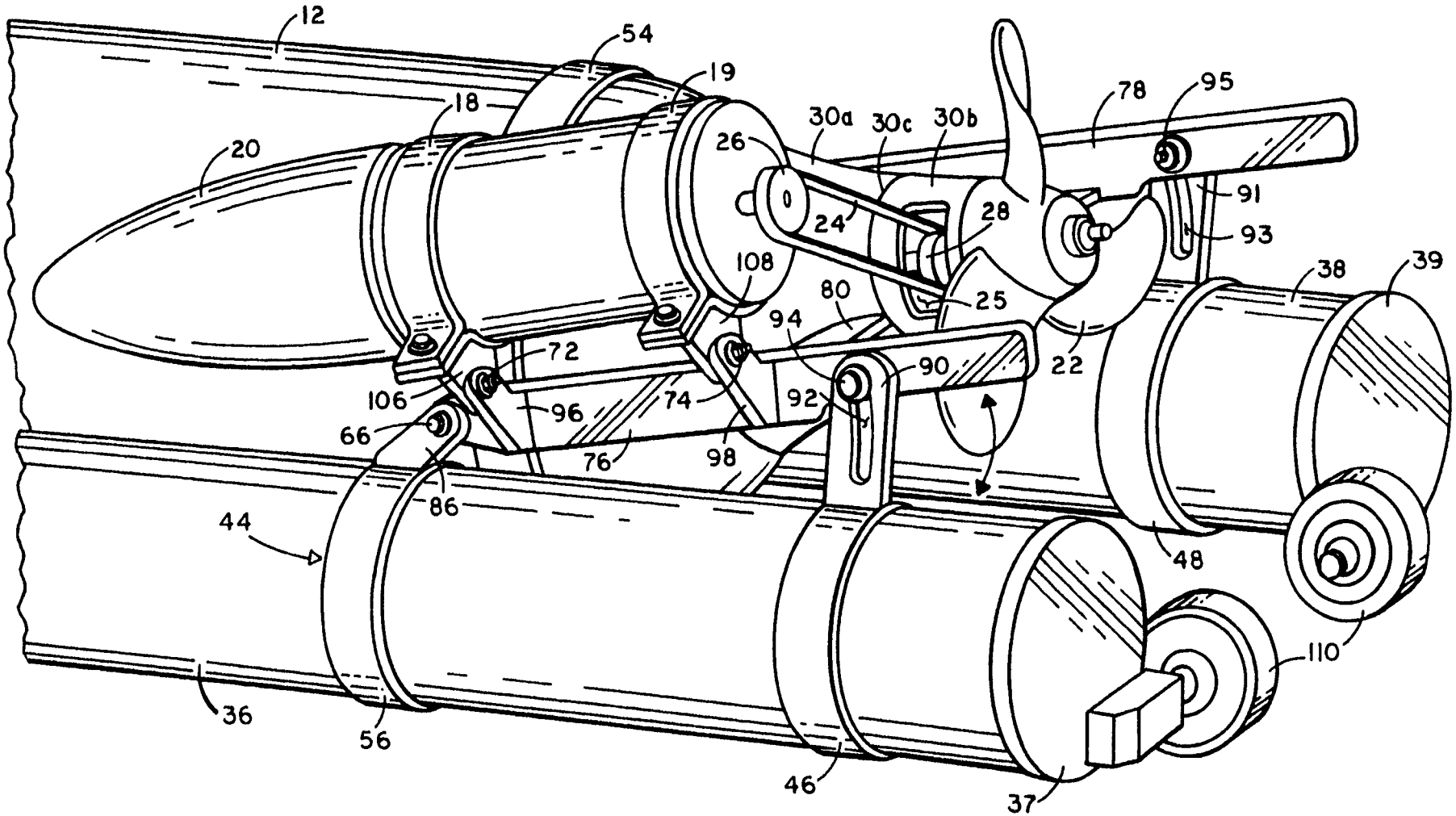
FIG. 6 is a perspective view revealing certain aspects of the rear portion of my novel propulsion arrangement, this view showing how the angularity of the propulsion motor and the propeller mounting arrangement can be selectively varied.

In other words, inasmuch as the thrust supplied by the propeller 22 necessarily cannot originate from the centerline of the diver's body, I have designed the mounting for my novel arrangement in such a way as to permit a component of the thrust delivered by the propeller to be directed to some extent away from the body of the diver; note FIG. 6. As will be seen in greater detail hereinafter, the angle of thrust furnished by the propeller 22 can reside at the most favorable angle for the circumstances of the particular diver utilizing my novel thrust arrangement. This important feature of my invention will be described at length hereinafter.

In FIG. 3 I illustrate the preferred relationship of the air tank 12 to the elongate battery tube 36, thus making clear that the air tank is located somewhat further away from the diver's back than are the battery tubes, and that the motor 20 protrudes outwardly (rearwardly) to a somewhat greater extent than does the air tank. Additionally shown in FIG. 3 are the forward mounting strap 42, the mid location mounting strap 44, and the rear strap 46 located adjacent the rear end of the battery tube 36.

As will be noted from FIG. 2, I utilize a fairing 30 that is located between the curved rear portion 13 of the air tank 12 and the propeller 22, with it being the intent of fairing 30 to cause water flowing past the tank 12 to thereafter flow, with minimum turbulence, through the blades of propeller 22. The fairing arrangement I utilize enables the upstream end of the fairing 30 to maintain a consistently good and effective relationship with the air tank 12. This of course required that the tank be designed to have the previously mentioned rounded aft portion 13, which is visible in FIG. 2, and in more detail in FIG. 8.

Figure 8:
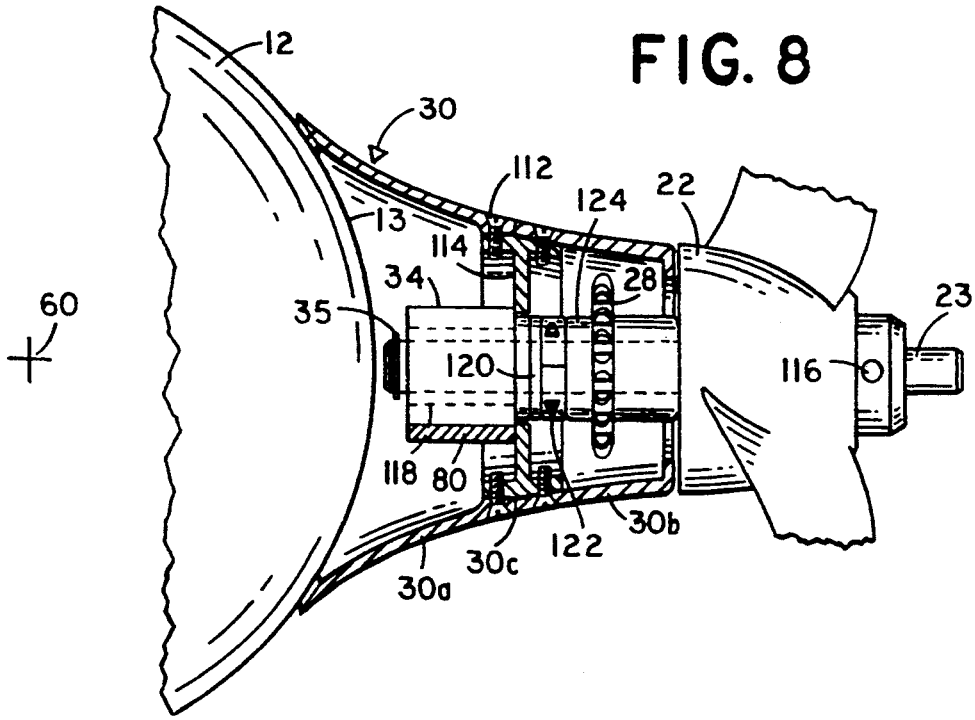
FIG. 8 is a side elevational view to a comparatively large scale of the arrangement for supporting and delivering power to the propeller, with the fairing being broken away to reveal internal construction.

As shown in FIGS. 6 and 8, the fairing 30 is constituted by forward section 30A and rearward section 30B, with FIG. 6 revealing the separation line 30C between the two sections. The forward and rear components 30A and 30B of fairing 30 are supported from an adjustable mounting arrangement to be discussed in conjunction with FIGS. 8 and 9.

Also shown in FIG. 2 is a dashed outline representing the location of shroud 32, which is of a diameter slightly larger than that of the propeller 22. The shroud 32 is best seen in FIG. 9, and it is used not only for improving propeller output, but also for providing a measure of safety for the diver.

Figure 9:
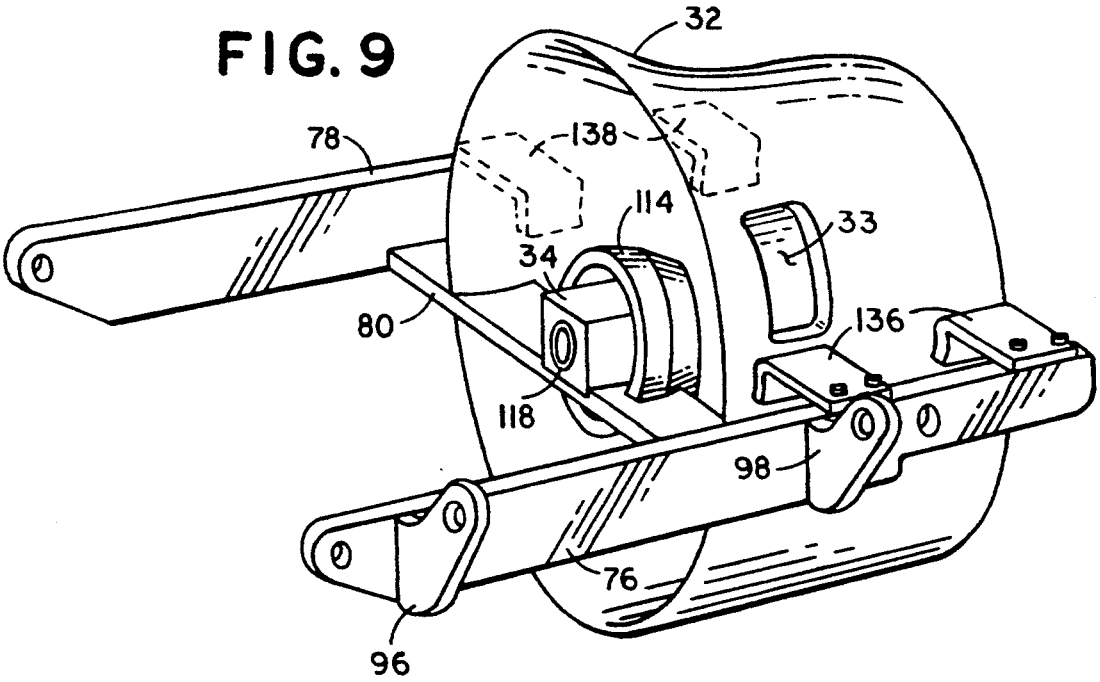
FIG. 9 is a view of the propeller shroud and its mounting arrangement, with certain drive elements removed for clarity.
Figure 10:
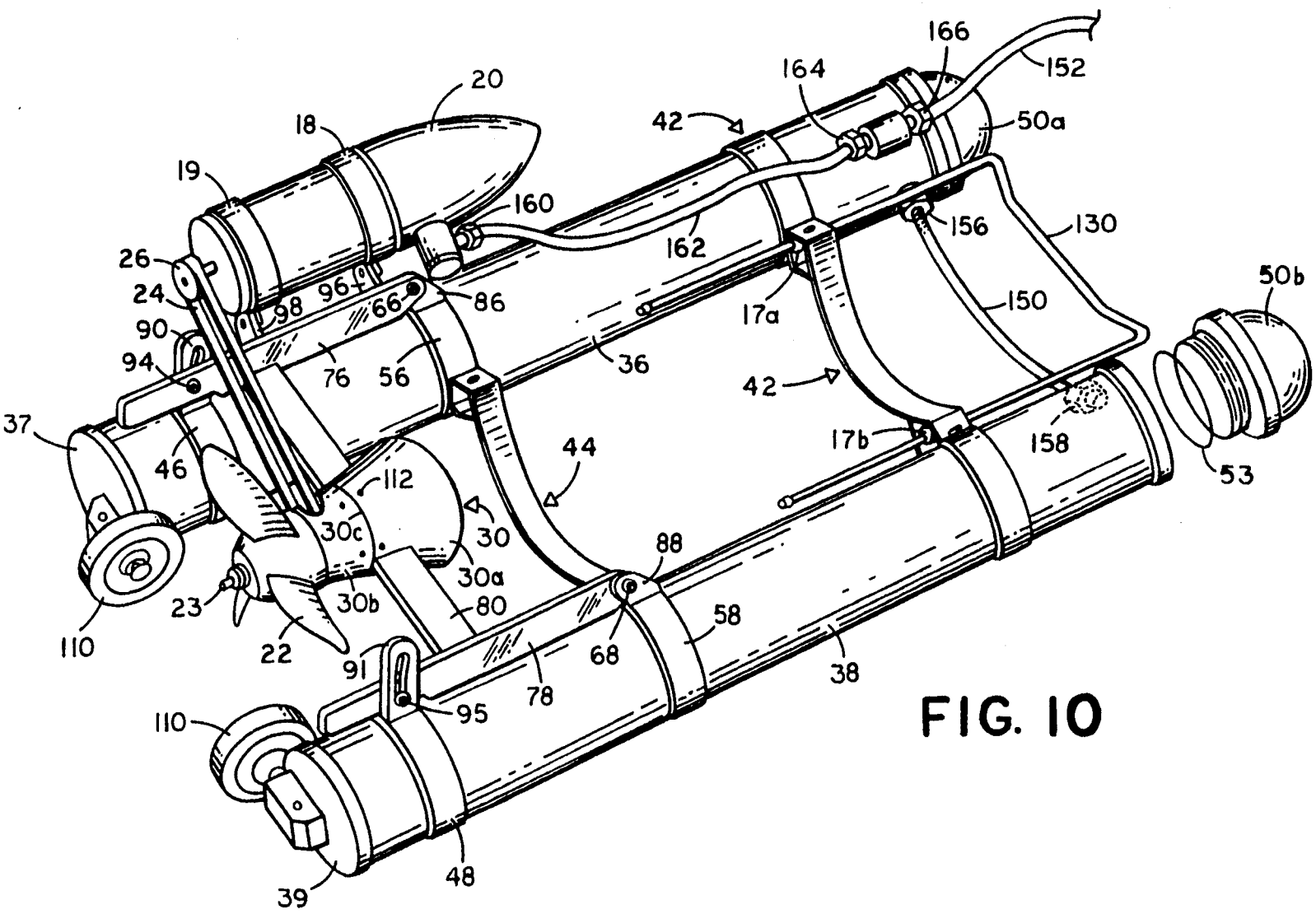
FIG. 10 is a perspective view from above in order to show the overall relationship of certain components of the system, with the propeller shroud, air tank, and other elements removed for clarity.

It is to be understood that a number of significant components associated with my novel tiltable propulsion arrangement are movable in unison, as the result of these components being supported upon the elongate, pivotally mounted members 76 and 78 that are visible in several of the figures, but best in FIGS. 6, 9 and 10. More particularly, the motor 20, the propeller 22, the propeller shaft 23, the fairing 30, the fairing mounting plate 114, and the bearing block 34 used with the propeller and other related components will move as a unit into the desired angular relationship with respect to the centerline of the air tank 12, rather than moving individually.

From FIGS. 8 and 9 it will be seen that the fairing mounting plate 114 and the bearing block 34 are shown, these being supported by a strut 80 that rigidly interconnects the elongate, pivotally mounted members 76 and 78. From FIG. 9 it is apparent that shroud 32 also moves with these other components, for the shroud is directly mounted on support arms 76 and 78. Certain related details will be discussed at further length hereinafter.

Electric power is supplied to the motor 20 by the use of an arrangement involving the use of a pair of elongate battery tubes 36 and 38, which are to be seen in full detail in FIGS. 1 and 10, and in fragmentary detail in certain other figures.

Domed members **50*a* and 50*b* form the front closures for battery tubes 36 and 38, respectively, which are visible in FIGS. 1 and 10, whereas members 37 and 39 form the rear closures for the battery tubes 36 and 38, respectively, these latter members being visible in FIGS. 2, 6 and 10**.

It is to be understood that in each of these tubes is contained a plurality of storage batteries connected in series. I prefer to refer to the interconnected storage batteries as battery packs. As an example, the battery tubes 36 and 38 can be somewhat longer than the air tank 12, and be made of fiberglass having ⅜ inch wall thickness. Typically each battery tube has a 4 inch inside diameter, with an O-ring seal being used at the location of the access to the battery tubes, in order to assure watertightness. Regarding the aforementioned domed cap **50*a* representing a front closure for tube 36, and the domed cap 50*b* representing a front closure for tube 38, it is to be understood that suitable O-rings are utilized with these members in order to assure watertightness, and in FIG. 10, I reveal the domed cap 50*b* in exploded relation, to reveal the use of O-ring 53**. I am not to be limited to any one type of battery, but in a preferred embodiment, I found that sealed lead-acid batteries are highly satisfactory. By way of example, batteries suitable for this purpose are made by Gates Energy Products of Denver, Colo.

I normally utilize three series connected, 2 volt battery cells forming each battery pack located inside each of the elongate battery tubes 36 and 38. The cutaway of tube 36 in FIG. 5 indicates the approximate size relationship of a typical battery 51 to the tube 36.

Figure 5:
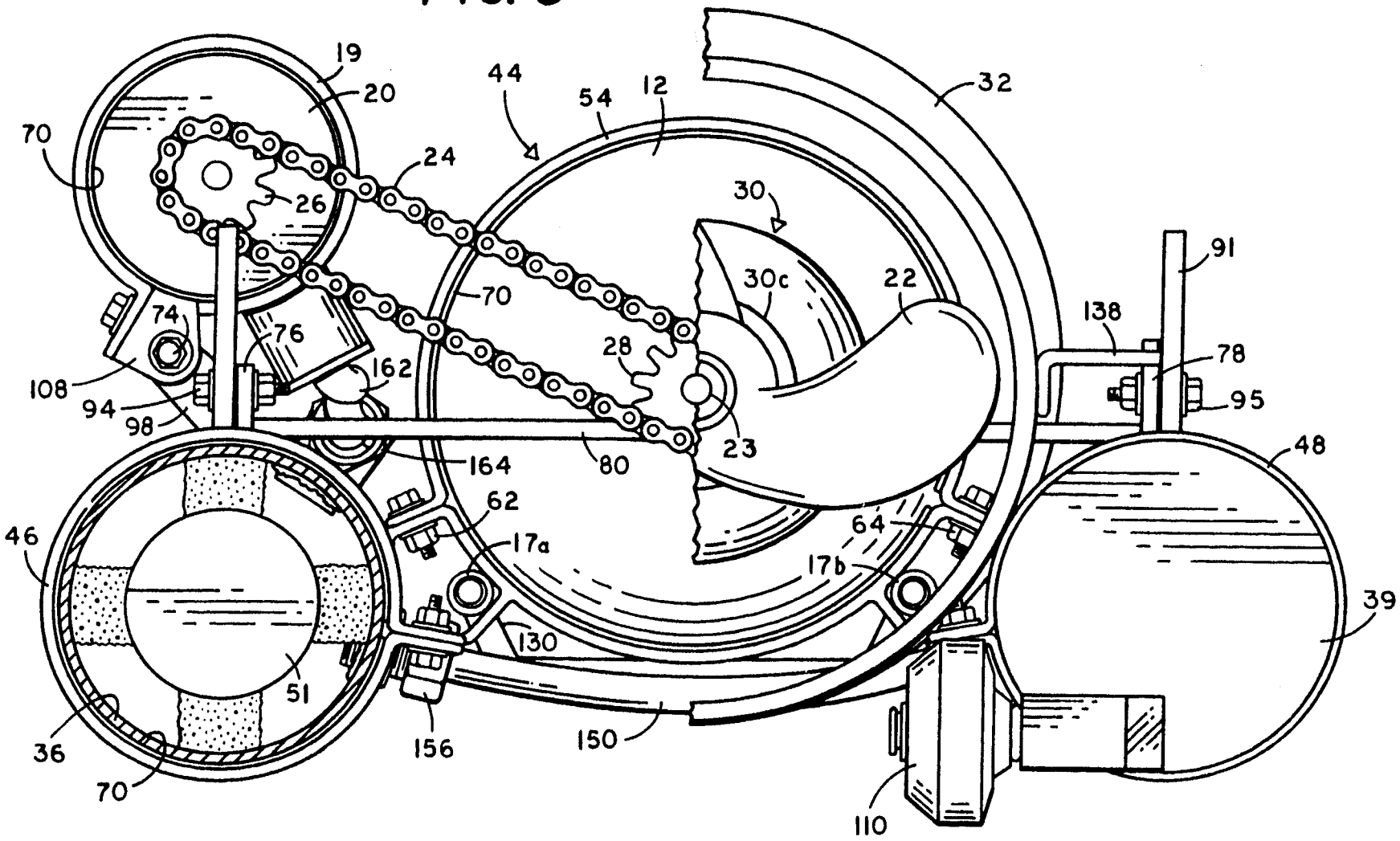
FIG. 5 is a split view from the rear looking forward, with the left side of this figure revealing certain details of the drive means for the propeller, and the large opening representing the location where the air tank is received, with the position of the propulsion motor being represented in the upper left portion of the drawing, over one of the battery tubes.

As will be noted in FIG. 5, I utilize a plurality of polyethylene strips to center and support the several batteries utilized in each tube, and I utilize a closely similar arrangement in battery tube 38. By virtue of this arrangement, I am readily able to combine the electrical outputs from the two battery tubes, such that the battery packs provide a total of twelve volts D.C. made available for delivery to the motor 20. I may place part of the electronic motor controls in either of the watertight battery tubes 36 or 38.

Inasmuch as the BC worn by the diver directly supports the air tank 12, means must be provided for supporting the battery tubes 36 and 38 in the desired relationship to the air tank, and to that end, I utilize a forward mounting strap 42 and a mid location mounting strap 44, located in the positions generally depicted in FIGS. 1 and 3, and even more clearly in FIG. 10. These straps are preferably made of relatively rigid material, such as aluminum, although I am not to be limited to this particular type of construction.

As best seen in FIG. 2, a rear strap 46 is mounted adjacent the rear end of battery tube 36, and rear strap 48 is mounted adjacent the rear end of battery tube 38. These two rear straps, in conjunction with the mid location mounting strap 44, form part of the support for the entire propulsion arrangement.

In accordance with an important aspect of my invention, I mount the motor 20 in a manner enabling it to be moved as the thrust line of the propeller 22 is moved, and as best seen in FIGS. 4, 6, 7 and 10, I provide the aforementioned elongate support arm 76 that extends between the strap 56 forming a part of the mid location mounting strap 44, and the rear strap 46 that encircles the rear end of battery tube 36. As will be discussed at greater length hereinafter, the forward end of the support arm 76 is pivotally mounted on offset bracket 86 that is mounted at an appropriate location on the portion 56 of the mid location mounting strap 44, whereas the rear end of the support arm is adjustably supported by an adjustment member or bracket 90 mounted on rear strap 46 at a location corresponding to the rear end of support arm 76; note FIG. 4 in particular.

It is thus to be seen that the support arm 76 forms a highly desirable support for the motor 20, so that the motor's angular position can be changed concomitantly with the change in thrust angle of the propeller, so as to avoid the introduction of twist into the endless drive member 24. As previously mentioned, the drive member 24 may be a chain, toothed belt or the like.

It is also to be noted that the motor mounting means are adjustable to enable the ready tightening of the chain or belt or other endless drive means 24 used to supply rotative motion to the propeller 22, with these to be described hereinafter in conjunction with FIGS. 5 and 6.

FIGS. 2, 6 and 10 reveal that I utilize a support arm 78 of a length identical to that of support arm 76, which may be regarded as in a balanced relationship to the support arm 76. It will be noted that the forward end of support arm 78 is supported from strap portion 58 of the mid location mounting strap 44, and the rear end of arm 78 is supported from the strap 48. Although the support arm 78 has nothing to do with supporting the electric motor 20, I may utilize a counterweight on the arm 78, in order that a balanced arrangement with the asymmetrically mounted motor 20 will be assured.

It has previously been mentioned that FIG. 5 is a split showing, that is, it presents a view looking forward from two separate locations on my novel underwater propulsion system. It is important to note that the gasket material 70 lies between the bands and the components they hold. From the left hand side of FIG. 5 it will be seen that I have shown the circular upper portion 54 of the mounting strap 44, with the portion 54 being specifically designed to encompass and surround the upper part of the air tank 12. It will be seen in FIG. 5 that the strap portion 54 is formed to have a noticeably larger diameter than the diameter of the strap 46, for strap 46 is configured, along with circular portion 56, to encompass the battery tube 36; note also FIGS. 4, 6 and 10. It is of course also true that circular portion 58 and strap 48 encompass the tube 38; note FIGS. 2 and 10.

With continuing reference to FIG. 5, it will be noted that I utilize nut and bolt combinations 62 and 64 for holding the strap portion 54 in tight contact with the rear portion of air tank 12. Thus, by loosening the nuts of bolts 62 and 64, as well as the counterpart of these nuts and bolts utilized in conjunction with portion 52 of the forward mounting strap 42 (see FIG. 1), the air tank 12 can be readily separated from the strap portions associated with the battery tubes. Typically the air tank 12 is removed from the straps 42 and 44 at such time as it is to be recharged with compressed air, but it is usually quite unnecessary at such time to loosen or remove any of the bolts associated with the battery tubes 36 and 38.

Similarly, I utilize a nut and bolt combination with the strap portion 56 and with strap portion 58 of mid band 44. Other nut and bolt combinations are utilized with rear bands 46 and 48, such that the previously discussed propulsion components and the battery tubes are tightly held in the desired relationship.

Should it ever become necessary or desirable for the battery tubes to be removed, I typically remove both battery tubes at essentially the same time, this being readily accomplished by removing the appropriate nut and bolt combinations. This is because at least one electrical cable extends between the battery tubes.

Figure 7:
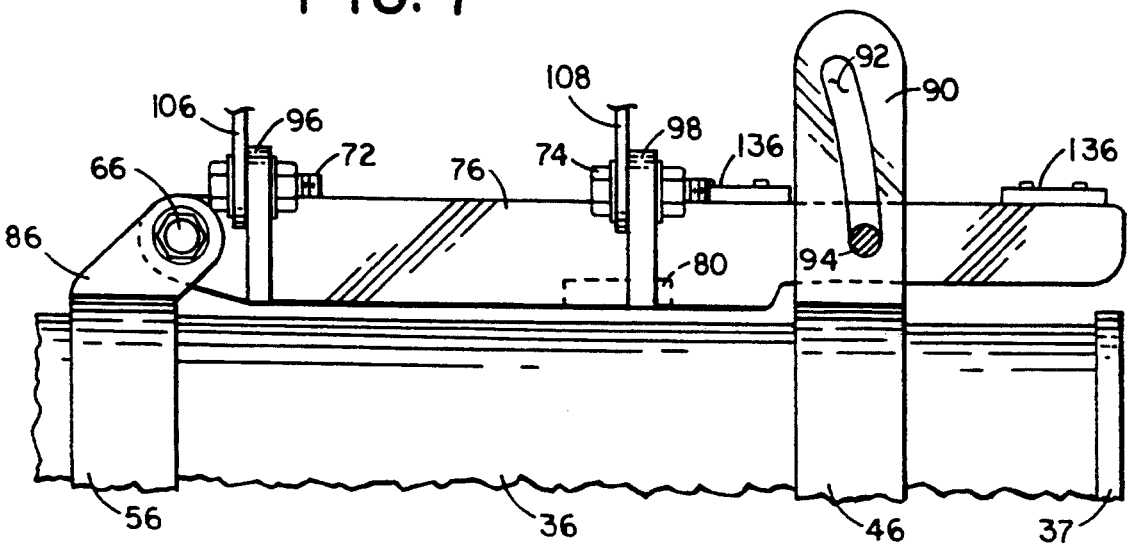
FIG. 7 is a side view, to a comparatively large scale, of the elongate support arm utilized to adjustably support the electric propulsion motor.

In accordance with a preferred embodiment of my invention, I utilize an upper portion of the strap portion 56 for supporting the electric motor 20, with this detail being visible in FIGS. 4, 6 and 7. As previously mentioned, I utilize the elongate support arm 76 for direct support of the motor 20, with forward and rear motor mounting means being affixed to the support arm 76 at spaced locations thereon. It is to be noted from FIG. 7 that the front end of arm 76 is supported from strap portion 56 of the mid location mounting strap 44; note also FIG. 6. The rear end of the support arm 76 is supported from the corresponding strap portion associated with the rear strap 46, as best seen in FIGS. 4, 6 and 7. The adjustability of the angularity of the support arm 76 with respect to the longitudinal centerline of the tank 12 will be discussed shortly, and as will be seen, a change of angle of the member 76 is responsible for changing the angularity of the motor 20 and related components, including the propeller 22.

Turning now to the perspective view of my invention revealed in FIG. 6, it will be seen that I have shown the elongate support arms 76 and 78 in outwardly deflected positions, with it to be noted that these support arms have maintained their parallel relationship. As previously mentioned, these support arms are rigidly interconnected by strut 80, which is also visible in FIGS. 2, 5, 6, 9 and 10, and as will shortly be seen in greater detail, the strut 80 supports the components associated with the propeller 22. The strut 80 is rigidly secured to the side of elongate arm 76, and secured to the same corresponding location to elongate arm 78, for example, by heliarc welding in the event aluminum is the material utilized in the construction of these components.

It is clearly shown in FIGS. 6, 9 and 10 that the support arms 76 and 78 form with strut 80 a generally "H" shaped configuration, although this is not completely true inasmuch as the strut 80 resides in what may be regarded as a flat position, whereas the support arms 76 and 78, in a manner of speaking, are standing on edge, and thus are not precisely disposed in the plane of the strut 80.

From FIGS. 8 and 9 it is made clear that upon the strut 80 the bearing block 34 is mounted, this bearing block being responsible for the support of the bearing 118 and therefore the propeller shaft 23. The strut 80 also supports the fairing mounting plate 114 responsible for the support of the forward and rear components of the fairing 30, as well as certain other components. Therefore, at such time as the support arms 76 and 78 are rotated away from their illustrated positions, the propeller and propeller shaft, the fairing 30, the shroud 32 and the other related components are moved to a like angular extent. The effective interaction between the rounded aft end 13 of the tank 12 and the fairing 30 causes water turbulence to be minimized, and resulting in an essentially undisturbed water flow to be presented to the propeller 22.

It is to be understood that elongate arm 78, best seen in FIGS. 6, 9 and 10, is of the same length and same basic construction as the support arm 76, although as previously mentioned, arm 78 is not concerned with support of the motor 20. However, inasmuch as the arm 78 along with arm 76 forms a support for strut 80, I prefer to refer to arm 78 as also being a support arm.

With reference back to FIG. 7, it is to be understood that the aforementioned offset bracket 86 is mounted at an appropriate location on the portion 56 of the mid location mounting strap 44. The offset bracket 86 is provided with a central hole, and the forward end of support arm 76 is provided with a hole, which holes are brought into an aligned relationship so as to receive the bolt 66. A suitable nut is applied to the backside of bolt 66 so that the front end of arm 76 can be held tightly to the bracket 86. As is thus to be seen, the bracket 86 forms the front support for elongate support arm 76. It is important to observe that the position of the hole in bracket 86 in which the bolt 66 is located bears a definite relationship to the location 60 on the longitudinal centerline of the tank 12 that represents the location about which the rear contour 13 of the tank is determined; note FIG. 8.

An essentially identical arrangement is provided for the front end of elongate support arm 78, with FIG. 10 revealing that the front end of arm 78 is provided with a mounting hole, so that when this latter hole has been brought into alignment with the hole located in the offset bracket 88 mounted on strap portion 58, a nut and bolt combination 68 can be used for holding these members in an operative, pivotal relationship.

From this arrangement it may be deduced that after appropriate bolts have been loosened, the user can readily rotate elongate support arms 76 and 78 to a desired angular extent away from a position in which these arms are parallel with the longitudinal centerline of the air tank 12, with this movement obviously having the result of changing the thrust line of the propeller 22. Because of the careful placement of the hole in bracket 86 in which the bolt 66 associated with the elongate support arm 76 is used, and the careful placement of the hole in the bracket 88 in which bolt 68 associated with the elongate support arm 78 is used, mid locations of the support arms 76 and 78 will maintain a consistent relationship to the point 60 on the longitudinal centerline of the air tank 12 (see FIG. 8) adjacent the curved rear end 13 of the tank, during all angular movements of the support arms about the bolts 66 and 68. In other words, the bolts 66 and 68 are laterally aligned with the aforementioned point 60 on the longitudinal centerline of the air tank 12.

It is thus to be seen that the center point from which the radius of curvature of the aft end 13 of the tank 12 is drawn, is coincident with the center point with respect to which the propeller fairing 30 moves as the propeller angularity changes with respect to the longitudinal centerline of the tank 12.

That the selected rotated position for the elongate support arm 76 can be maintained, I utilize, as revealed in FIGS. 6, 7 and 10, the aforementioned adjustment member or bracket 90 mounted on rear strap 46 at a location corresponding to the rear end of support arm 76. The adjustment bracket 90 is provided with an arcuately configured slot 92 therein; see FIGS. 6 and 7. Similarly, an adjustment member or bracket 91 is mounted on rear strap 48, with this bracket being provided with arcuate slot 93. A hole is provided adjacent the rear end of the support arm 76, in which a nut and bolt combination 94 is mounted, the bolt portion of which is moved along the arcuate slot 92 at such time as the support arm 76 is rotated about its mounting in the offset bracket 86. Similarly, a hole is provided adjacent the rear end of the support arm 78, in which a nut and bolt combination 95 is mounted, the bolt portion of which is moved along the arcuate slot 93 at such time as the support arm 78 is rotated about its mounting in the offset bracket 88.

As is obvious, I tighten the nut on both of bolts 94 and 95 after the support arms and the bolts associated therewith have been adjusted to the desired positions.

It has previously been mentioned that the strut 80 forms a rigid interconnection between elongate support arms 76 and 78, and this of course means that support arm 78 is customarily moved at the same time as the support arm 76 is moved. As is obvious, the nuts associated with bolts 94 and 95 affixing the rear ends of the elongate support arms 76 and 78 to their respective adjustment brackets are both to be loosened when rotation of the support arms is to be effected. As indicated above, the respective nut on each of these bolts is to be tightened at such time as the selected new angular position for the support arms has been reached.

With reference to FIGS. 6 and 7, it will be seen that motor support brackets 96 and 98 are mounted in a spaced apart, carefully aligned relationship on the elongate support arm 76, with these brackets being connected to motor mounting brackets 106 and 108 respectively. Brackets 96 and 98 are also visible in FIG. 9. A suitable hole is provided in each of these four brackets, such that a nut and bolt combination 72 may be used to join the motor support bracket 96 to the motor mounting bracket 106, and a similar nut and bolt arrangement 74 used to join motor support bracket 98 to the motor mounting bracket 108.

As previously mentioned, it is desirable to be able to place an appropriate amount of tension in the endless drive member 24, and this is achieved by being able to swing the motor 20 laterally to an appropriate extent about the aligned motor support brackets 96 and 98. As should be obvious to all those persons skilled in the art, upon the loosening of the nut and bolt arrangement 72 joining bracket 96 to bracket 106, and the nut and bolt arrangement 74 utilized for joining bracket 98 to bracket 108, the motor 20 may be moved laterally about its mounting to whatever extent required to accomplish a proper tensioning of the endless drive member 24.

Although I may use a toothed belt as the endless drive member, and use suitable pulleys therewith, I prefer to use a non-metallic sprocket-engaging chain similar to the type used on a bicycle as the endless drive member 24, but quite obviously, I am not to be limited to this. In the event the non-metallic chain is used, the motor pulley takes the form of a sprocket 26, and similarly, the pulley on propeller shaft 23 takes the form of a sprocket 28, visible in FIG. 8, and it is between the sprockets 26 and 28 that the endless drive member 24 extends.

Upon appropriate tightening of the chain 24 being achieved, the nut and bolt combinations 72 and 74 joining the brackets together are tightened, such that there will be no tendency of the chain to become loose.

It is to be realized that inasmuch as the elongate support arm 76 carries the motor mounting means, which of course is the basic support for motor support brackets 96 and 98, the angular relationship of the centerline of the motor 20 with respect to the centerline of the air tank 12 can, quite advantageously, be readily changed. This is accomplished by loosening the bolt 66 associated with the offset bracket 86, and the nut and bolt 94 associated with the bracket 90, and then moving the support arm 76 about the bolt 66 to the desired new position.

As previously mentioned, it is also necessary to move the elongate support arm 78 to a like extent, which is accomplished by loosening the bolts 68 and 95. At such time as a desired angle of thrust has been achieved, the nut and bolt arrangement 66 associated with offset bracket 86, and the nut and bolt arrangement 94 associated with the bracket 90 are then tightened so as to secure the elongate support arm 76 in the new angular relationship. It is to be understood that the corresponding bolts associated with the support arm 78 are also tightened at this same time.

It has been previously explained that the elongate support arms 76 and 78 support the strut 80, and this strut in turn supports the bearing block 34 in which the propeller shaft 23 is operatively mounted. Therefore, the rotation of the support arms also serves to move the propeller and the propeller shaft concomitantly with the movement of the motor, thus avoiding any unnecessary twisting of the endless drive means 24, which in the preferred embodiment is a non-metallic chain.

The very important relationship of the location of the point 60 on the longitudinal centerline of the tank 12 as depicted of FIG. 8, to the position of the hole utilized in each of the offset brackets 86 and 88, partly visible in FIG. 6 and fully visible in FIG. 10, has already been mentioned. It is of course in the holes in these brackets that the bolts 66 and 68 are utilized. It is about point 60 on the longitudinal centerline of the air tank 12 that all points on the curved line representing the rear portion 13 of the tank are equidistant. Because of this advantageous arrangement, the forward peripheral edge of the fairing section 30A can be expected to maintain a close but non-interfering relationship to the curved rear portion 13 of the air tank 12 during all movements of the elongate arms 76 and 78 about their pivot points.

It has already been mentioned with respect to FIGS. 8 and 9 that the bearing block 34 is rigidly mounted at the mid location of the horizontally disposed strut 80, and also that the propeller shaft is angularly movable about the curved rear end 13 of the air tank during rotation of the elongate arms 76 and 78 and therefore the strut 80. Such rotation is of course brought about in order to adjust the thrust angle of the propeller 22. The propeller shaft 23 is rotatably supported in the bearing block 34, which in the preferred embodiment involves the use of a plastic bearing possessing suitable wearing qualities, but I am not to be limited to this particular bearing material.

With reference to FIG. 8, the forward end of the propeller shaft 23 is held in the desired relationship to the bearing block 34 by means of E-ring 35, whereas a shaft collar 122 is utilized in the mid portion of the propeller shaft 23 adjacent the bearing block. It is also to be noted from FIG. 8 that I prefer to use a thrust washer 120 between the shaft collar 122 and the bearing 118.

It has been previously mentioned that the rear or aft end 13 of the air tank 12 is curved at a particular radius, and this radius is substantially identical to the radius about which the front of the propeller shaft 23 is moved during the selective tilt of the propeller thrust line. Point 60, to be seen in FIG. 8, is of course the point on the longitudinal centerline of the tank 12 from which each radius is drawn.

Although I am not to be limited to any specific spacing, in one embodiment, the distance between the front end of the propeller shaft 23 and the aft end of the tank 13 was one-fourth inch.

As should now be clear, when rotative power is delivered from the motor 20 to the sprocket 26, thence to the endless drive member 24 and thus to the sprocket 28 tightly secured to the propeller shaft 23, the shaft 23 and therefore the propeller 22 will be driven in rotation so as to propel the diver through the water. It is important to note that the spacer 124 keeps the endless drive member 24 from interfering with fairing mounting plate 114.

As previously mentioned, the portions of fairing 30, consisting of forward section 30A and rearward section 30B, are mounted on the fairing mounting plate 114, visible in FIG. 8. The fairing mounting plate 114 is bonded to the bearing block 34 by a strong adhesive, such as Versilok, which is manufactured by Lord Company of Erie, Pa. Also to be seen in FIG. 8 are the screws 112 utilized for accomplishing the attachment of the fairing sections to the mounting plate 114.

Visible in FIG. 6 is the arcuate opening 25 in fairing portion 30B, through which opening the endless drive chain 24 extends in order to encircle the sprocket 28. Similarly, in FIG. 9 I reveal the arcuate opening 33 in the propeller shroud 32 that is provided in order that the drive chain 24 can extend therethrough. It will also be noted in FIG. 9 that brackets 136 are utilized for supporting the shroud 32 from the support arm 76, with one of the brackets 138 utilized for supporting the other side of the shroud 32 from the support arm 78 being visible on the right hand side of FIG. 5.

Turning now to a consideration of FIG. 10, it will be seen that the battery cable 150 exits the battery tube 38 through the watertight fitting 158. The battery tube 36 receives the battery cable 150 through its watertight fitting 156. Motor cable 162 exits the battery tube 36 through the watertight fitting 164 and enters the motor 20 through the watertight fitting 160. Also visible in FIG. 10 is the fitting 166 through which the system control cable 152 from the system controller 143 enters the battery tube 36.

With reference now to FIG. 11, it is there to be seen that I mount my novel system controller 143 on a mounting pad 140 secured to the forearm of the diver, such as by the use of straps. Velcro strips **140*a* mounted on the pad 140 are arranged to receive the watertight system controller case 142, in which the system controller 143** is contained. Because of this arrangement, the controller can be readily removed from or applied to the diver's forearm.

In the event that a rescue should happen to be needed with regard to a diver using my novel system, the rescuer, though familiar with the buckles and straps associated with the BC (buoyancy compensator), may fail to recognize other equipment attached to the diver's forearm. Quite advantageously, my novel controller 143 can be expected to peel readily away from its Velcro mounting, thus allowing the rescue diver to jettison the injured diver's equipment should such become necessary.

Visible in FIG. 11 is the system control cable 152 which, as previously indicated, serves as an electrical connection between the system controller 143 and the motor control components located in the battery tube 36. Quite obviously, the motor control components could instead be located in the battery tube 38.

The system controller 143, which is contained inside the watertight case 142, involves the dive computer 141, the control buttons 144,145 and 146, the motor speed indicator 147 and the battery power indicator 148. The electrical components of this novel device are potted into the case 142, to prevent the undesired intrusion of water, and the switches and buttons I use are hermetically sealed for the same reason.

The system controller 143 I prefer to use involves CMOS integrated circuits, with digital logic being utilized to control propulsion speed. I prefer this type of arrangement inasmuch as digital logic makes precise control readily possible, and CMOS circuitry reduces power drain on the battery.

As an indication of the arrangement I prefer to use, power is supplied from the battery, via the system control cable 152, to a free running IC clock located in the system controller 143, which IC clock supplies all timing and control pulses. Upon the diver actuating the "Up" button 145, or the "Down" button 144 shown in FIG. 11, the logic will be caused to output an increase or decrease of speed control to the motor control unit 170 which, as discussed hereinafter, is preferably located in battery tube 36. The control of the speed of the motor 20 is accomplished through "up-down" counters that feed digital data to a digital-to-analog converter. This IC will then convert the digital signal to an analog current, which is fed to a DC operational amplifier that in turn outputs a proportional DC voltage to the motor control 170.

As will be clear to those skilled in this art, upon the diver depressing the "Up" button 145, the propulsion motor 20 is caused to rotate and thus cause propeller 22 to rotate in the proper direction. Motor speed is caused to increase as long as the diver continuously depresses the button 145. The preferred arrangement is such that the diver can operate the propulsion motor at a selected speed less than full speed by removing his finger from button 145 at the appropriate time. It is to be understood that by maintaining pressure on the "Up" button 145, the diver can cause the motor speed to gradually increase until full speed is reached. In a converse manner, the motor speed can be caused to decrease gradually by keeping the "Down" button 144 depressed.

Continuing with a discussion of FIG. 11, for the convenience of the diver, motor speed is indicated by an LED bar graph display 147, and a similar display 148 indicates remaining battery power.

For safety reasons, I provide a button 146 at a convenient location on the case 142, which button can be operated should the diver need to suddenly disengage power from the motor 20, so that the propeller will stop rotating. It will be noted that this button 146 is significantly larger than the other buttons so that there can be no misunderstanding as to the position or function of this button. When the diver wishes to immediately shut off the propulsion motor 20, he need only momentarily depress the all-stop or motor cutoff button 146, which will have the direct effect of causing the motor 20 to stop rotating.

To later restart the motor, button 145 must be depressed again, with the diver, as before, maintaining pressure on this button until such time as the motor has attained the desired speed of rotation.

Figure 12:
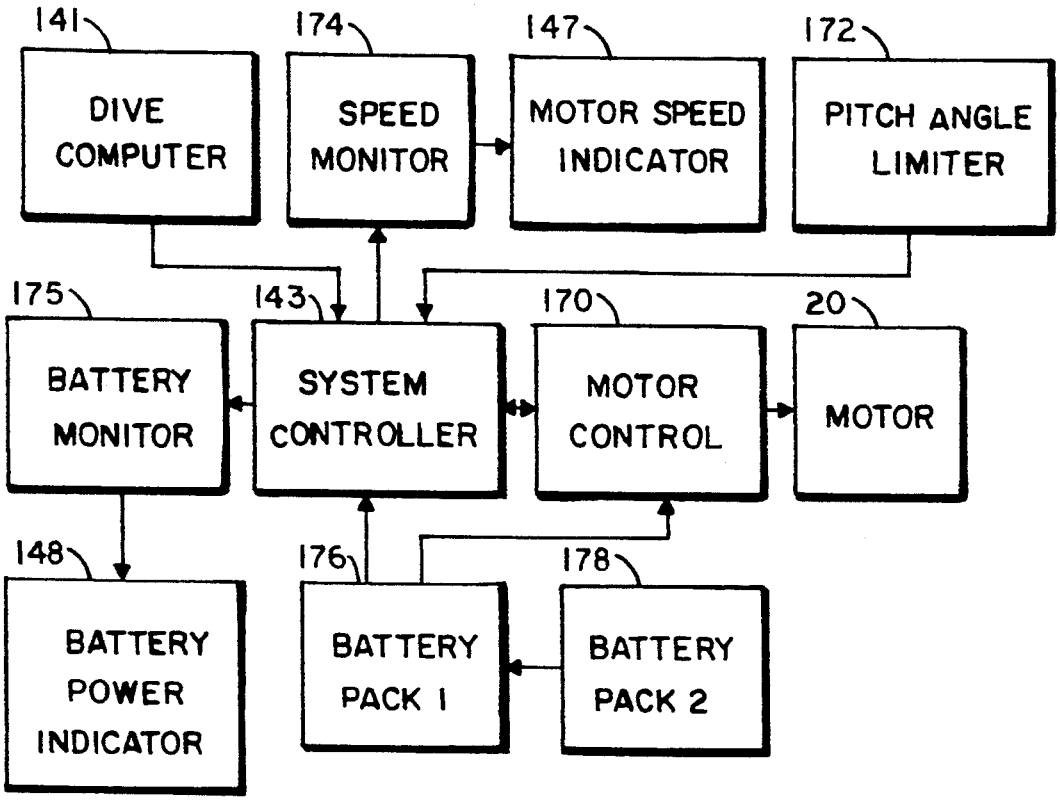
FIG. 12 is a block diagram of the components associated with control over the propulsion motor.

With reference now to FIG. 12, a block diagram of the electrical arrangement utilized in conjunction with this invention is set forth, including the system controller 143, the motor control 170, and certain devices associated with the safety of the diver. The physical location of the motor control 170 is preferably in one of the battery tubes, such as tube 36, as previously mentioned. The motor control I prefer to use is of conventional construction, and I do not predicate any invention in its details. As an example, the motor control 170 may be made by Minn Kota, of Mankato, Minn. The motor 20 I use may also be made by this same company, but obviously I am not to be limited to this.

By its very nature, the motor control 170 may become quite warm in use, which might well have a deleterious effect on sensitive electronic components. Therefore, the manufacturer typically mounts components of this type on a finned heat sink, so that components of the motor control that become hot can dissipate such heat directly to the air. Because such a use of air cooling is not realistically possible in my utilization, I typically place the components of the motor control 170 likely to undertake a substantial rise in temperature in close physical contact with the metal cap 50*a*, located on the tube 36. This arrangement makes it readily possible for these components to be kept sufficiently cool by the surrounding water.

By now it should be clear that the system controller 143 secured to the diver's forearm serves to direct the output of the motor control 170, which in turn governs the power supplied by the battery pack 176 and the battery pack 178 to the motor 20. FIG. 12 reveals that the system controller 143 also directs inputs from the battery packs 176 and 178 to a battery monitor 175, located in the watertight case 142 removably secured to the diver's forearm. The battery monitor in turn displays the battery condition on the battery power indicator 148, located in a conspicuous position on the case 142, such that it may be readily seen by the diver.

The motor control 170 outputs through the system controller 143 to the speed monitor 174, which in turn displays through the motor speed indicator 147 located in the case 142. Also located in the case 142 is the dive computer 141, which I also refer to as the ascent limiter. This is a major safety device that I prefer to be electrically interconnected with the system controller 143, and its function it is to continuously gauge the ascent rate of the diver, and to automatically disengage electric power from the motor if a predetermined safe ascent rate is exceeded. In other words, the ascent limiter or dive computer 141 prevents a powered ascent of such a nature as to cause injury or death to the diver.

The implementation of this ascent limiter I prefer to use for safety reasons may involve a commercially available dive computer. The device I prefer is made by Marathon (U.S. Pat. No. 4,192,001) interfaced to the motor control 170, but obviously I am not to be limited to this.

Normally a dive computer warns a diver of an unsafe ascent by giving some sort of signal. The Marathon computer accomplishes this by the use of a flashing light. Rather than having this light turn on, in accordance with my invention, the dive computer 141 instructs the controller to disengage electric power from the motor in the event of an unsafe ascent rate. This is very important because while under power, the diver may inadvertently exceed his safe ascent rate due to his inability to accurately reference his path.

Another safety device is a pitch angle limiter 172, which is depicted in FIG. 12 and is located in one or the other of the battery tubes. This device prevents the motor 20 from operating should the pitch of the system exceed the negative and positive pitch angle limits. My device preferably utilizes mercury switches in order to achieve this goal, and by way of example, the motor is automatically deprived of power if the system deviates from the desired horizontal position by a significant amount.

As should now be clear, should either the dive computer 141 or the pitch angle limiter 172 deviate from the predetermined maximum settings, the system controller 143 automatically causes the motor control 170 to disengage electric power from the motor 20.

As an added functional safeguard, the circuitry of the system controller 143 is designed with a maximum and minimum speed loop block. This arrangement is utilized to prevent a clock pulse count reset to either maximum-to-minimum, or the inverse situation, either of which could cause personal injury to the diver, or else equipment damage.

As to the operation of my device, in preparing for the dive, the diver disconnects the charger from the batteries and allows sufficient time for the battery tubes to ventilate. As is known, $H_2$ is generated during charging of lead acid batteries. The air tank (which has been removed from the system for re-fill) is now slid through the tank bands from the front until it rests against the propeller fairing 30A. The necessary bolts are now tightened, securing the tank 12 firmly to the system. The batteries are now connected by joining the connectors, and the domed end caps 50*a* and 50*b* are screwed down to a proper degree of tightness upon the forward ends of the battery tubes 36 and 38, respectively, to prevent the entry of water.

The diver next prepares his BC by uncoupling the BC strap and passing the ends around the air tank 12 and between the tank bands 42 and 44. The BC strap, the location of which is shown at 14 in FIGS. 1 and 3, is then recoupled and adjusted so that it will clamp firmly around the air tank at the proper location.

If the diver is not at the site, my novel underwater propulsion system can be carted to the location by the use of an extensible tow handle 130. The tow handle 130 is of generally U-shaped construction, and is slidably disposed in the forward mounting strap 42, in the manner shown in FIG. 10, where supports 17*a* and 17*b* for the handle are shown. Therefore, at such time as the diver wishes to travel overland, he pulls out the handle 130 such that it extends beyond the front end of the air tank 12, so that he can grasp the handle without any degree of difficulty. I prefer to use an "E" ring at each end of the arms of the U-shaped handle member, to prevent the handle separating from the supports 17*a* and 17*b*.

To permit my novel underwater propulsion device to move easily overland, I provide a pair of wheels 110 located at the bottom of the battery tubes. These wheels are visible in FIGS. 2, 4 and 6, but are perhaps best seen in FIG. 10. Upon extending the tow handle 130 to the operational position, my novel device can be easily rolled along the ground on its pair of wheels 110.

Once at the site, the diver slides the tow handle 130 back to the retracted position and prepares his equipment in the normal manner.

The diver then straps the mounting pad 140 to one of his forearms, typically the left forearm, for it is this device that serves as a means for removably attaching the system controller 143 in a conspicuous position on the diver's forearm. Velcro was chosen because it allows the controller to be peeled away from the pad 140 without it being necessary to unfasten any straps or buckles.

It is to be noted that the aforementioned electrical cable 152 utilized to connect the system controller 143 to the source of power typically extends along the diver's arm and over his shoulder, terminating at the left battery tube 36. Before beginning the dive, the diver should activate the dive computer by rotating the cap 149, which serves as an on-off switch. The cap 149 is visible in FIG. 11.

Once in the water, the diver can activate the system by depressing the button 145 located on the controller 143. On depressing this button, the drive motor does not start up instantly, but rather takes a few seconds to reach full speed. Releasing the button 145 at any time will hold the motor at that particular speed of rotation. Depressing the button 145 again will cause the motor to again commence an increase in speed, with this speed increase continuing as long as the button is held down, until full speed of rotation of the motor is reached.

Should the diver wish to decrease his speed through the water, he needs only to depress the button 144, which brings about an opposite effect to the previously described procedure, that is, a gradual decrease in motor speed.

Should the situation warrant, the diver can of course immediately deprive the electric motor of power by momentarily depressing the motor cutoff button 146.

Thrust angle adjustments that will improve the diver's angle of plane in the water while being powered can be made by the diver's buddy after the diver has shut off the propulsion motor 20. To accomplish angle adjustments, he loosens the bolt 94, associated with the bracket 90, and the bolt 95, associated with the bracket 91, for this enables the thrust angle of the propeller with respect to the diver's body to be readily changed in an appropriate manner, after which the bolts are retightened. The motor 20 can then be restarted.

As should now be apparent, I have provided a novel underwater propulsion system that can be produced at reasonable cost, that increases the ability of the standard diver to enjoy underwater travel and exploration, and that can be used with utmost safety.

I claim:

1. A propeller driven underwater propulsion system for use by a scuba diver, comprising at least one elongate air tank to be carried on the back of the diver, said tank having a front end as well as a rear end, with the longitudinal centerline of the tank substantially in line with the length direction of the diver's body, the longitudinal centerline of said tank residing in a plane approximately perpendicular to the plane of the shoulders of the diver, a propeller mounted on a propeller shaft, said propeller shaft being operatively mounted for rotation at a location closely adjacent said rear end of said tank, but neither rigidly connected to nor directly supported by said tank, the centerline of said propeller shaft being disposed in said plane approximately perpendicular to the shoulders of the diver, through which the longitudinal centerline of said tank passes, motor mounting means for operatively supporting a motor adjacent said tank and provided with an output shaft, said output shaft being operatively connected by a torque transmitting device for continuously supplying rotative power to said propeller shaft, so as to cause said propeller shaft to rotate and to cause said propeller to provide a line of thrust at a location directed essentially rearwardly of said tank, the angularity of said propeller shaft with respect to the longitudinal centerline of said tank being readily modified at the behest of the diver so as to enable the line of thrust of said propeller to be tilted away from the longitudinal centerline of said tank and the body of the diver, to an extent necessary to compensate for the fact that line of thrust of said propeller is inherently laterally offset from the body of the diver, the selective tilt of the line of thrust of said propeller enabling the diver to readily travel in a desired direction underwater, said propeller shaft being supported by at least one support arm disposed approximately parallel to said propeller shaft, an attachment point disposed at the forwardmost portion of said support arm, said attachment point serving as a pivot about which said arm is rotatable with respect to the longitudinal centerline of said tank, during the selective tilt of said propeller thrust line to compensate for the lateral offset of said thrust line from the diver's body.

2. The propeller driven underwater propulsion system for use by a scuba diver as recited in claim 1 in which said motor is an electric motor, with means being provided for supplying controlled amounts of electric power to said motor, to control the speed of rotation of said output shaft.

3. The propeller driven underwater propulsion system for use by a scuba diver as recited in claim 1 in which said torque transmitting device is an endless driving member.

4. The propeller driven underwater propulsion system for use by a scuba diver as recited in claim 3 in which said endless driving member is a drive chain.

5. The propeller driven underwater propulsion system for use by a scuba diver as recited in claim 3 in which said endless driving member is a drive belt.

6. The propeller driven underwater propulsion system for use by a scuba diver as recited in claim 1 in which said motor mounting means and said propeller shaft are relatedly movable in tilt, so as at all times to move to a like angular extent, thus permitting said endless driving member to continue to supply power from said motor to said propeller, throughout the entire range of tilt of the line of thrust of said propeller.

7. The propeller driven underwater propulsion system for use by a scuba diver as recited in claim 1 in which said air tank is of lightweight construction, being a number of pounds lighter than an equivalent volume of water, thus providing a positive buoyancy and lifting effect serving to offset to at least some extent, the negative buoyancy of the other components associated with said system.

8. The propeller drive underwater propulsion system for use by a scuba diver as recited in claim 1 in said air tank provides a breathable air supply for the diver.

9. The propeller driven underwater propulsion system for use by a scuba diver as recited in claim 1 in which said rear end of said air tank is curved at a radius, said radius being substantially identical to the radius about which the front of said propeller shaft is moved during the selective tilt of said propeller thrust line, with the point from which each radius is drawn being at substantially identical locations on said longitudinal centerline of said tank.

10. The propeller drive underwater propulsion system for use by a scuba diver as recited in claim 1 in which said air tank forms a basis of structural support for the related components of the system.

11. The propeller driven underwater propulsion system for use by a scuba diver as recited in claim 1 in which said attachment point serving as a pivot is substantially coincident on the longitudinal centerline of said tank, with the point about which the radius of curvature of the aft end of said tank is drawn.

12. The propeller driven underwater propulsion system for use by a scuba diver as recited in claim 1 in which said propeller shaft is mounted essentially midway between a pair of elongate support arms disposed approximately parallel to said propeller shaft, with one arm being located on each side of said tank, an attachment point disposed at the forwardmost portion of each of said support arms, said attachment point serving as a pivot about which said arms are rotatable with respect to the longitudinal centerline of said tank, during the selective tilt of said propeller thrust line to compensate for the lateral offset of said thrust line from the diver's body.

13. The propeller driven underwater propulsion system for use by a scuba diver as recited in claim 12 in which said attachment point serving as a pivot is substantially coincident on the longitudinal centerline of said tank, with the point about which the radius of curvature of the aft end of said tank is drawn.

14. The propeller driven underwater propulsion system for use by a scuba diver as recited in claim 12 in which means are provided for locking said arms in a position of selected tilt of said propeller shaft with respect to the longitudinal centerline of said tank.

15. The propeller driven underwater propulsion system for use by a scuba diver as recited in claim 12 in which one of said elongate support arms serves as the support for said motor mounting means, with the longitudinal centerline of said motor being essentially parallel to said one support arm.

16. The propeller driven underwater propulsion system for use by a scuba diver as recited in claim 15 in which said rear end of said one support arm is slidably mounted in an adjustment member mounted on a strap encircling said battery tube, said adjustment member containing an arcuate slot, and tightening means operatively associated with said one support arm and said adjustment member for enabling the user to establish a desired angle of inclination of said support arm with respect to the longitudinal centerline of said air tank, the angular adjustments of said one support arm enabling the centerline of said motor, and the propeller operatively associated therewith, to be moved to a selected angle with respect to the longitudinal centerline of said air tank.

17. A propeller driven underwater propulsion system for use by a scuba diver, comprising at least one elongate air tank to be carried on the back of the diver, said tank having a front end as well as a rear end, with the longitudinal centerline of the tank substantially in line with the length direction of the diver's body, the longitudinal centerline of said tank residing in a plane approximately perpendicular to the plane of the shoulders of the diver, motor mounting means supported adjacent said tank, said motor mounting means serving to support an electric propulsion motor in an offset, angularly adjustable relationship to said tank, with said motor having an output shaft, means for supplying controlled amounts of electric power to said motor, to control the speed of rotation of said output shaft, and a propeller mounted on a propeller shaft, said propeller shaft being supported for rotation at a location closely adjacent said rear end of said tank, but neither rigidly connected to nor directly supported by said tank, the centerline of said propeller shaft being disposed in said plane approximately perpendicular to the shoulders of the diver, through which the longitudinal centerline of said tank passes, a torque transmitting device for delivering power from said output shaft of said motor to said propeller shaft, so as to cause said propeller to provide a line of thrust at a location directed essentially rearwardly of said tank, representing the propulsive effort of the system, the angularity of said propeller shaft with respect to the longitudinal centerline of said tank being readily modified at the behest of the diver so as to enable the line of thrust of said propeller to be tilted away from the longitudinal centerline of said tank and the body of the diver, to an extent necessary to compensate for the fact that line of thrust of said propeller is inherently laterally offset from the body of the diver, such modification of the angularity of said propeller shaft improving the diver's plane through the water, said propeller shaft being supported by at least one support arm disposed approximately parallel to said propeller shaft, an attachment point disposed at the forwardmost portion of said support arm, said attachment point serving as a pivot about which said arm is rotatable with respect to the longitudinal centerline of said tank, during the selective tilt of said propeller thrust line to compensate for the lateral offset of said thrust line from the diver's body.

18. The propeller driven underwater propulsion system for use by a scuba diver as recited in claim 17 in which said torque transmitting device is an endless driving member.

19. The propeller driven underwater propulsion system for use by a scuba diver as recited in claim 18 in which said endless driving member is a drive chain.

20. The propeller driven underwater propulsion system for use by a scuba diver as recited in claim 18 in which said endless driving member is a drive belt.

21. The propeller driven underwater propulsion system for use by a scuba diver as recited in claim 17 in which said motor mounting means and said propeller shaft are relatedly movable in tilt, so as at all times to move to a like angular extent, thus permitting said endless driving member to continue to supply power from said motor to said propeller, throughout the entire range of tilt of the line of thrust of said propeller.

22. The propeller driven underwater propulsion system for use by a scuba diver as recited in claim 17 in which said air tank is of lightweight construction, being a number of pounds lighter than an equivalent volume of water, thus providing a positive buoyancy and lifting effect serving to offset to at least some extent, the negative buoyancy of the other components associated with said system.

23. The propeller driven underwater propulsion system for use by a scuba diver as recited in claim 17 in which said rear end of said air tank is curved at a radius, said radius being substantially identical to the radius about which the front of said propeller shaft is moved during the selective tilt of said propeller thrust line to compensate for the lateral offset of said thrust line from the diver's body.

24. The propeller drive underwater propulsion system for use by a scuba diver as recited in claim 17 in said air tank provides a breathable air supply for the diver.

25. The propeller drive underwater propulsion system for use by a scuba diver as recited in claim 17 in which said air tank forms a basis for the structural support for the related components of the system.

26. The propeller driven underwater propulsion system for use by a scuba diver as recited in claim 17 in which said propeller shaft is mounted essentially midway between a pair of elongate support arms disposed approximately parallel to said propeller shaft, with one arm being located on each side of said tank, an attachment point disposed at the forwardmost portion of each of said support arms, said attachment points serving as pivots about which said arms are rotatable with respect to the longitudinal centerline of said tank, during the selective tilt of said propeller thrust line to compensate for the lateral offset of said thrust line from the diver's body.

27. The propeller driven underwater propulsion system for use by a scuba diver as recited in claim 26 in which means are provided for locking said support arms in a position of selected tilt of said propeller shaft with respect to the longitudinal centerline of said tank.

28. The propeller driven underwater propulsion system for use by a scuba diver as recited in claim 26 in which one of said elongate support arms serves as the support for said motor mounting means, with the centerline of said motor being essentially parallel to said one support arm.

29. A propeller driven underwater propulsion system as recited in claim 28 in which said motor mounting means involve the use of forward and rear motor mounting means, said forward and rear motor mounting means being angularly adjustable, thus enabling lateral movements of said motor while the centerline of said motor remains essentially parallel to said support arm.

30. A propeller driven underwater propulsion system as recited in claim 29 which said motor has an output means, and said propeller has an input means, and an endless driving member operatively connecting said motor output means to said propeller input means, said angular adjustments of said forward and rear motor mounting means enabling said endless driving member to be kept taut.

31. The propeller driven underwater propulsion system for use by a scuba diver as recited in claim 28 in which said rear end of said one support arm is slidably mounted in an adjustment member mounted on a strap encircling said battery tube, said adjustment member containing an arcuate slot, and tightening means operatively associated with said one support arm and said adjustment member for enabling the user to establish a desired angle of inclination of said support arm means with respect to the longitudinal centerline of said air tank, the angular adjustments of said support arm means enabling the centerline of said motor, and the propeller operatively associated therewith, to be moved to a selected angle with respect to the longitudinal centerline of said air tank.

32. A propeller driven underwater propulsion system as recited in claim 28 in which structural means associated with said one support arm serves as the mounting for said propeller shaft, said mounting means moving with said support arm during angular adjustments of the motor, and contemporaneously serving to move said propeller shaft to the same angular extent as that to which said motor is moved.

33. A propeller driven underwater propulsion system as recited in claim 28 in which said one support arm is operatively connected to mounting means for said propeller shaft, the centerline of said propeller shaft being angularly movable at the behest of the user from a location essentially in coincidence with the longitudinal centerline of the air tank, to a relationship in which the longitudinal centerline of said propeller shaft bears a definite angular relationship to the longitudinal centerline of the air tank, while at all times remaining in a vertical plane passing through said air tank, said motor having an output sprocket and said propeller shaft having an input sprocket, and an endless drive chain operatively connected between said output pulley and said input pulley, such that rotation can be imparted to said propeller shaft, the angular adjustments of said one support arm enabling the centerline of said motor and the centerline of said propeller shaft to be at all times angularly altered in essentially identical amounts.

34. The propeller driven underwater propulsion system for use by a scuba diver as recited in claim 17 in which said means for supplying controlled amounts of electric power to said motor includes at least one watertight battery tube secured to said tank, in which tube a rechargeable storage battery is contained, and electric leads from said battery being connected via a motor control and a selectively operable system controller to said motor, to bring about a desired operation of said motor.

35. The propeller driven underwater propulsion system for use by a scuba diver as recited in claim 34 in which said selectively operable system controller is contained on a mounting pad removably attached to a forearm of the diver.

36. The propeller driven underwater propulsion system for use by a scuba diver as recited in claim 35 in which said system controller is connected to control components located in said battery tube.

37. The propeller driven underwater propulsion system for use by a scuba diver as recited in claim 35 in which at least two buttons associated with motor speed are disposed on said system controller, said buttons being operatively connected via said control components, said buttons being connected such that by maintaining pressure on one button, the diver can cause the motor speed to gradually increase until full speed is reached, whereas by maintaining pressure on the other button, the motor speed can be caused to gradually decrease.

38. The propeller driven underwater propulsion system for use by a scuba diver as recited in claim 34 in which an external portion of said battery tube serves as the mounting for said electric motor.

39. The propeller driven underwater propulsion system for use by a scuba diver as recited in claim 34 in which wheels are provided on a lower portion of said tank, thereby enabling the user to move the propulsion system overland either before or after a dive.

40. The propeller driven underwater propulsion system for use by a scuba diver as recited in claim 34, in which a handle is operatively associated with said tank, which handle is readily movable between stored and active positions.

41. A propeller driven underwater propulsion system for use by a scuba diver, comprising at least one elongate air tank to be carried on the back of the diver, said tank having a front end as well as a rear end, with the longitudinal centerline of the tank substantially in line with the length direction of the diver's body, the longitudinal centerline of said tank residing in a plane approximately perpendicular to the plane of the shoulders of the diver, motor mounting means supported adjacent said tank, said motor mounting means serving to support an electric propulsion motor in an offset, angularly adjustable relationship to said tank, with said motor having an output shaft, control means for supplying controlled amounts of electric power to said motor, to control the speed of rotation of said output shaft, at least a portion of said control means being disposed in a watertight case adapted to be carried on the forearm of the diver, said control means containing means for enabling the electric propulsion motor to be started or stopped on command, said control means also utilizing at least one automatically functioning safety device; a propeller mounted on a propeller shaft, said propeller shaft being supported for rotation at a location closely adjacent said rear end of said tank, but neither rigidly connected to nor directly supported by said tank, the centerline of said propeller shaft being disposed in said plane approximately perpendicular to the shoulders of the diver, through which the longitudinal centerline of said tank passes, a torque transmitting device for delivering power from said output shaft of said motor to said propeller shaft, so as to cause said propeller to provide a line of thrust at a location directed essentially rearwardly of said tank, representing the propulsive effort of the system, the angularity of said propeller shaft with respect to the longitudinal centerline of said tank being readily modified at the behest of the diver so as to enable the line of thrust of said propeller to be tilted away from the longitudinal centerline of said tank and the body of the diver, to an extent necessary to compensate for the fact that line of thrust of said propeller is inherently laterally offset from the body of the diver, such modification of the angularity of said propeller shaft improving the diver's plane through the water, said control means utilizing an ascent limiter as a safety device, said ascent limiter functioning to continuously gauge the ascent rate of the diver, said ascent limiter automatically functioning to disengage electric power from said motor should a predetermined safe ascent rate be exceeded by the diver.

42. A propeller driven underwater propulsion system for use by a scuba diver, comprising at least one elongate air tank to be carried on the back of the diver, said tank having a front end as well as a rear end, with the longitudinal centerline of the tank substantially in line with the length direction of the diver's body, the longitudinal centerline of said tank residing in a plane approximately perpendicular to the plane of the shoulders of the diver, motor mounting means supported adjacent said tank, said motor mounting means serving to support an electric propulsion motor in an offset, angularly adjustable relationship to said tank, with said motor having an output shaft, control means for supplying controlled amounts of electric power to said motor, to control the speed of rotation of said output shaft, at least a portion of said control means being disposed in a watertight case adapted to be carried on the forearm of the diver, said control means containing means for enabling the electric propulsion motor to be started or stopped on command, said control means also utilizing at least one automatically functioning safety device; a propeller mounted on a propeller shaft, said propeller shaft being supported for rotation at a location closely adjacent said rear end of said tank, but neither rigidly connected to nor directly supported by said tank, the centerline of said propeller shaft being disposed in said plane approximately perpendicular to the shoulders of the diver, through which the longitudinal centerline of said tank passes, a torque transmitting device for delivering power from said output shaft of said motor to said propeller shaft, so as to cause said propeller to provide a line of thrust at a location directed essentially rearwardly of said tank, representing the propulsive effort of the system, the angularity of said propeller shaft with respect to the longitudinal centerline of said tank being readily modified at the behest of the diver so as to enable the line of thrust of said propeller to be tilted away from the longitudinal centerline of said tank and the body of the diver, to an extent necessary to compensate for the fact that line of thrust of said propeller is inherently laterally offset from the body of the diver, such modification of the angularity of said propeller shaft improving the diver's plane through the water, said control means utilizing a pitch angle limiter as a safety device, said pitch angle limiter employing the use of at least one mercury switch, said mercury switch reacting automatically to disengage electric power from said motor should a pre-established angle limit be exceeded by the diver.

43. A propeller driven underwater propulsion system for use by a scuba diver, comprising at least one elongate air tank to be carried on the back of the diver, said tank having a front end as well as a rear end, with the longitudinal centerline of the tank substantially in line with the length direction of the diver's body, the longitudinal centerline of said tank residing in a plane approximately perpendicular to the plane of the shoulders of the diver, motor mounting means supported adjacent said tank, said motor mounting means serving to support an electric propulsion motor in an offset, angularly adjustable relationship to said tank, with said motor having an output shaft, means for supplying controlled amounts of electric power to said motor, to control the speed of rotation of said output shaft, at least a portion of said control means being disposed in a watertight case adapted to be carried on the forearm of the diver, said control means containing means for enabling the electric propulsion motor to be started or stopped on command, said control means also utilizing at least one automatically functioning safety device; a propeller mounted on a propeller shaft, said propeller shaft being supported for rotation at a location closely adjacent said rear end of said tank, but neither rigidly connected to nor directly supported by said tank, the centerline of said propeller shaft being disposed in said plane approximately perpendicular to the shoulders of the diver, through which the longitudinal centerline of said tank passes, a torque transmitting device for delivering power from said output shaft of said motor to said propeller shaft, so as to cause said propeller to provide a line of thrust at a location directed essentially rearwardly of said tank, representing the propulsive effort of the system, the angularity of said propeller shaft with respect to the longitudinal centerline of said tank being readily modified at the behest of the diver so as to enable the line of thrust of said propeller to be tilted away from the longitudinal centerline of said tank and the body of the diver, to an extent necessary to compensate for the fact that line of thrust of said propeller is inherently laterally offset from the body of the diver, such modification of the angularity of said propeller shaft improving the diver's plane through the water, said watertight case, in which at least a portion of said control means is disposed, being capable of being removably attached to the forearm of the diver by the use of Velcro.

44. A propeller driven underwater propulsion system for use by a scuba diver, comprising at least one elongate air tank to be carried on the back of the diver, said tank having a front end as well as a rear end, with the longitudinal centerline of the tank substantially in line with the length direction of the diver's body, the longitudinal centerline of said tank residing in a plane approximately perpendicular to the plane of the shoulders of the diver, motor mounting means supported adjacent said tank, said motor mounting means serving to support an electric propulsion motor in an offset, angularly adjustable relationship to said tank, with said motor having an output shaft, means for supplying controlled amounts of electric power to said motor, to control the speed of rotation of said output shaft, said control means containing means for enabling the electric propulsion motor to be started or stopped on command, said control means also utilizing at least one automatically functioning safety device; a propeller mounted on a propeller shaft, said propeller shaft being supported for rotation at a location closely adjacent said rear end of said tank, but neither rigidly connected to nor directly supported by said tank, the centerline of said propeller shaft being disposed in said plane approximately perpendicular to the shoulders of the diver, through which the longitudinal centerline of said tank passes, a torque transmitting device for delivering power from said output shaft of said motor to said propeller shaft, so as to cause said propeller to provide a line of thrust at a location directed essentially rearwardly of said tank, representing the propulsive effort of the system, the angularity of said propeller shaft with respect to the longitudinal centerline of said tank being readily modified at the behest of the diver so as to enable the line of thrust of said propeller to be tilted away from the longitudinal centerline of said tank and the body of the diver, to an extent necessary to compensate for the fact that line of thrust of said propeller is inherently laterally offset from the body of the diver, such modification of the angularity of said propeller shaft improving the diver's plane through the water, said control means utilizing an ascent limiter as a safety device, said ascent limiter functioning to continuously gauge the ascent rate of the diver, said ascent limiter automatically functioning to disengage electric power from said motor should a predetermined safe ascent rate be exceeded by the diver.

45. A propeller driven underwater propulsion system for use by a scuba diver, comprising at least one elongate air tank to be carried on the back of the diver, said tank having a front end as well as a rear end, with the longitudinal centerline of the tank substantially in line with the length direction of the diver's body, the longitudinal centerline of said tank residing in a plane approximately perpendicular to the plane of the shoulders of the diver, motor mounting means supported adjacent said tank, said motor mounting means serving to support an electric propulsion motor in an offset, angularly adjustable relationship to said tank, with said motor having an output shaft, means for supplying controlled amounts of electric power to said motor, to control the speed of rotation of said output shaft, said control means containing means for enabling the electric propulsion motor to be started or stopped on command, said control means also utilizing at least one automatically functioning safety device; a propeller mounted on a propeller shaft, said propeller shaft being supported for rotation at a location closely adjacent said rear end of said tank, but neither rigidly connected to nor directly supported by said tank, the centerline of said propeller shaft being disposed in said plane approximately perpendicular to the shoulders of the diver, through which the longitudinal centerline of said tank passes, a torque transmitting device for delivering power from said output shaft of said motor to said propeller shaft, so as to cause said propeller to provide a line of thrust at a location directed essentially rearwardly of said tank, representing the propulsive effort of the system, the angularity of said propeller shaft with respect to the longitudinal centerline of said tank being readily modified at the behest of the diver so as to enable the line of thrust of said propeller to be tilted away from the longitudinal centerline of said tank and the body of the diver, to an extent necessary to compensate for the fact that line of thrust of said propeller is inherently laterally offset from the body of the diver, such modification of the angularity of said propeller shaft improving the diver's plane through the water, said control means utilizing a pitch angle limiter as a safety device, said pitch angle limiter employing the use of at least one mercury switch, said mercury switch reacting automatically to disengage electric power from said motor should a pre-established angle limit be exceeded by the diver.

46. A propeller driven underwater propulsion system for use by a scuba diver, comprising at least one elongate air tank to be carried on the back of the diver, said tank having a front end as well as a rear end and a longitudinal centerline, motor mounting means supported adjacent said tank, said motor mounting means serving to support an electric propulsion motor in an offset relationship to said tank, with said motor having an output shaft, means for supplying controlled amounts of electric power to said motor, to control the speed of rotation of said output shaft, and a propeller mounted on a propeller shaft, said propeller shaft being supported for rotation at a location closely adjacent said rear end of said tank, but neither rigidly connected to nor directly supported by said tank, a torque transmitting device for delivering power from said output shaft of said motor to said propeller shaft, so as to cause said propeller, when rotating, to provide a line of thrust at a location essentially rearward of said tank, representing the propulsive effort of the system, said propeller shaft being supported by at least one support arm disposed approximately parallel to said propeller shaft, means for supporting said support arm for selective angular adjustment of said support arm with respect to the longitudinal centerline of said tank, the angularity of said propeller shaft with respect to the longitudinal centerline of said tank being readily modified at the behest of the diver by angular adjustment of said support arm, thus to enable the line of thrust of said propeller to be selectively tilted away from the longitudinal centerline of said tank and the body of the diver, to compensate for the lateral offset of said line of thrust from the diver's body.

* * * * *